US012593893B2

(12) United States Patent
Cavaliere et al.

(10) Patent No.: US 12,593,893 B2
(45) Date of Patent: Apr. 7, 2026

(54) ATHLETIC SYSTEMS

(71) Applicant: NIKE, Inc., Beaverton, OR (US)

(72) Inventors: Sergio Cavaliere, Venice (IT); John W. Cross, Portland, OR (US); Neil Crumbleholme, Lake Oswego, OR (US); Roberto De Marchi, Volpago del Montello (IT); Samuel G. Lacey, Portland, OR (US); Ryan R. Larson, Portland, OR (US); Marlon Rainville, Portland, OR (US); Matthew R. Tegenkamp, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/794,555

(22) Filed: Aug. 5, 2024

(65) Prior Publication Data

US 2026/0033593 A1 Feb. 5, 2026

(51) Int. Cl.
*A43B 13/20* (2006.01)
*A43B 5/18* (2006.01)
(Continued)

(52) U.S. Cl.
CPC ..... *A43B 13/20* (2013.01); *A43B 5/185* (2013.01); *A43B 7/24* (2013.01); *A43B 13/16* (2013.01); *A43B 13/18* (2013.01); *A43B 13/185* (2013.01)

(58) Field of Classification Search
CPC ..... A43B 13/20; A43B 13/18; A43B 13/185; A43B 7/24
(Continued)

(56) References Cited

U.S. PATENT DOCUMENTS 4,305,212 A 12/1981 Coomer
4,449,306 A 5/1984 Cavanagh
(Continued)

FOREIGN PATENT DOCUMENTS

CN 107114858 A 9/2017
CN 114680423 A 7/2022
(Continued)

OTHER PUBLICATIONS

Long JT, Sirota N, Klein JP, Wertsch JJ, Janisse D, Harris GF. Biomechanics of the double rocker sole shoe: gait kinematics and kinetics. Conf Proc IEEE Eng Med Biol Soc. 2004;2004:5107-10. doi: 10.1109/IEMBS.2004.1404411. PMID: 17271467; PMCID: PMC2211387. (last accessed Jul. 8, 2024.) 4 pages.
(Continued)

*Primary Examiner* — Marie D Bays
(74) *Attorney, Agent, or Firm* — Bookoff McAndrews PLLC

(57) ABSTRACT

An article of footwear with medial and lateral sides; an upper; and a sole structure coupled to the upper. The sole structure has: a first plate with a first and second surface, the first plate including a first knob extending from the second surface and one or more apertures disposed through the first and second surfaces; a second plate with a first and second surface, the second plate including a second knob extending from the first surface of the second plate and one or more apertures disposed through the first surface of the second plate; a first cushioning element disposed on the medial side of the article of footwear, wherein the first cushioning element is disposed between the first and second plates; and a second cushioning element disposed on the lateral side of the article of footwear, wherein the second cushioning element is disposed between the first and second plates.

19 Claims, 19 Drawing Sheets

(51) Int. Cl.
*A43B 7/24* (2006.01)
*A43B 13/16* (2006.01)
*A43B 13/18* (2006.01)

(58) Field of Classification Search
USPC ..... 36/29, 142–144
See application file for complete search history.

(56) References Cited

U.S. PATENT DOCUMENTS

| | | | | |
|---|---|---|---|---|
| 4,484,397 | A | 11/1984 | Curley, Jr. | |
| 4,949,476 | A | 8/1990 | Anderie | |
| 5,243,776 | A | 9/1993 | Zelinko | |
| 5,279,051 | A | 1/1994 | Whatley | |
| 5,572,805 | A | 11/1996 | Giese et al. | |
| 5,701,687 | A | 12/1997 | Schmidt et al. | |
| 5,813,146 | A | 9/1998 | Gutkowski et al. | |
| 5,881,478 | A | 3/1999 | McMahon et al. | |
| 6,550,160 | B2 | 4/2003 | Miller, II | |
| 6,568,102 | B1 | 5/2003 | Healy et al. | |
| 6,789,331 | B1 | 9/2004 | Ellis, III | |
| 6,860,034 | B2 | 3/2005 | Schmid | |
| 7,143,529 | B2 | 12/2006 | Robinson, Jr. et al. | |
| 7,194,826 | B2 | 3/2007 | Ungari | |
| 7,278,445 | B2 | 10/2007 | Marvin et al. | |
| 7,290,358 | B2 | 11/2007 | Francis | |
| 7,395,616 | B2 | 7/2008 | Fallon | |
| 7,472,496 | B2 | 1/2009 | Potter et al. | |
| 7,540,100 | B2 | 6/2009 | Pawlus et al. | |
| 7,770,306 | B2 | 8/2010 | Lyden | |
| 7,788,824 | B2 | 9/2010 | Hann | |
| 8,112,905 | B2 | 2/2012 | Bemis et al. | |
| 8,186,081 | B2 | 5/2012 | Wilson, III et al. | |
| 8,453,349 | B2 | 6/2013 | Auger et al. | |
| 8,656,611 | B2 | 2/2014 | Baucom et al. | |
| 8,752,306 | B2 | 6/2014 | Goldston et al. | |
| 8,819,965 | B2 | 9/2014 | Baker et al. | |
| 9,241,535 | B2 | 1/2016 | Baudouin et al. | |
| 9,357,813 | B2 | 6/2016 | Lyden | |
| 9,615,627 | B2 | 4/2017 | Nurse et al. | |
| 9,655,400 | B2 | 5/2017 | Selner | |
| 9,756,904 | B2 | 9/2017 | Orand | |
| 9,808,045 | B2 | 11/2017 | Carlson et al. | |
| 9,961,960 | B2 | 5/2018 | Desmarais | |
| 10,010,137 | B2 | 7/2018 | Foxen | |
| 10,575,585 | B2 | 3/2020 | Kirk et al. | |
| 10,743,613 | B2 | 8/2020 | Farris et al. | |
| 10,750,817 | B2 | 8/2020 | Barnes et al. | |
| 10,758,001 | B2 | 9/2020 | Case et al. | |
| 10,791,795 | B2 | 10/2020 | Campos, II et al. | |
| 11,076,659 | B2 | 8/2021 | Baker | |
| 11,284,669 | B2 | 3/2022 | Reinhardt et al. | |
| 11,412,812 | B2 | 8/2022 | Barnes et al. | |
| 11,583,032 | B2 | 2/2023 | Weast et al. | |
| 11,612,209 | B2 | 3/2023 | Ashcroft et al. | |
| 11,617,412 | B2 | 4/2023 | Orand | |
| 11,622,603 | B2 | 4/2023 | Elder et al. | |
| 12,161,190 | B1 | 12/2024 | Razon | |
| 2003/0154628 | A1 | 8/2003 | Gyr | |
| 2008/0052960 | A1 | 3/2008 | Belley et al. | |
| 2008/0072462 | A1 | 3/2008 | Fusco | |
| 2013/0312288 | A1 | 11/2013 | Colthurst | |
| 2015/0157089 | A1 | 6/2015 | Schumacher et al. | |
| 2016/0073732 | A1* | 3/2016 | Ernst | B29C 51/32 36/28 |
| 2017/0095030 | A1 | 4/2017 | Brandstätter | |
| 2019/0110551 | A1 | 4/2019 | Walker | |
| 2019/0320759 | A1* | 10/2019 | Conrad | A43B 13/181 |
| 2020/0375310 | A1 | 12/2020 | Weast et al. | |
| 2021/0030112 | A1* | 2/2021 | Amoako | A43B 13/20 |
| 2021/0052037 | A1 | 2/2021 | Greenspan et al. | |
| 2021/0085024 | A1 | 3/2021 | Chen et al. | |
| 2021/0145121 | A1* | 5/2021 | Page | A43B 13/127 |
| 2021/0169170 | A1* | 6/2021 | Fahmi | A43B 13/41 |
| 2021/0361030 | A1 | 11/2021 | Hopkins | |
| 2022/0015502 | A1 | 1/2022 | Goldston et al. | |
| 2022/0225729 | A1 | 7/2022 | Bonin et al. | |
| 2022/0248804 | A1* | 8/2022 | Chang | A43B 13/026 |
| 2023/0127595 | A1* | 4/2023 | Chang | A43B 7/1415 36/28 |
| 2023/0142549 | A1 | 5/2023 | Dunning | |
| 2023/0172311 | A1 | 6/2023 | Walker et al. | |
| 2023/0189926 | A1* | 6/2023 | Hardman | A43B 13/186 36/29 |
| 2023/0270207 | A1* | 8/2023 | Stauffer | A43B 13/185 36/28 |
| 2023/0337785 | A1 | 10/2023 | Kobayashi et al. | |
| 2024/0373980 | A1* | 11/2024 | Andrews | A43B 13/122 |
| 2025/0204637 | A1 | 6/2025 | Corcoran-Tadd et al. | |
| 2025/0204638 | A1 | 6/2025 | Wölfel et al. | |

FOREIGN PATENT DOCUMENTS

| | | | |
|---|---|---|---|
| CN | 114766776 | B | 11/2023 |
| DE | 2805426 | A1 | 8/1979 |
| EP | 3749130 | B1 | 12/2020 |
| EP | 3761825 | A1 | 1/2021 |
| GB | 1144676 | A | 3/1969 |
| WO | 2021001573 | A1 | 1/2021 |

OTHER PUBLICATIONS

JD. Salas, PT, DPT, and CSCS, "HOKA ONE ONE Speed Evo R—Track Spike Review," Apr. 1, 2021. https://www.doctorsofrunning.com/2021/04/hoka-one-one-speed-evo-r-track-spike.html (accessed Jul. 18, 2024).

"Asics Javelin Pro 3—Mens Throwing Spikes—Sunrise Red/Black," Sportitude. https://www.sportitude.com.au/p/asics-javelin-pro-3-sunrise-red-black (accessed Jul. 18, 2024).

Hoka Cielo X 2 MD. Accessed: Jan. 30, 2024. Available at: https://www.hoka.com/en/au/spikes/cielo-x-2-md/1134534.html?dwvar_1134534_color=CEPR.

Nike Air Zoom Maxfly Track & Field Sprinting Spikes. Nike. Available at: https://www.nike.com/t/air-zoom-maxfly-track-field-sprinting-spikes-C2ZBRP/DH5359-600? (accessed Jul. 18, 2024).

Nike Alphafly 2. Accessed: Jan. 30, 2024. Available at: https://www.nike.com/t/alphafly-2-mens-road-racing-shoes-Bstm8X/DN3555-600? (accessed Jul. 18, 2024).

Nike Dragonfly Spike. Running Warehouse. Publication date not available. Available at: https://www.runningwarehouse.com/Nike_Dragonfly_Spike/descpage-NZMZD08.html? (accessed Jul. 18, 2024).

On Cloudspike 1500m. Accessed: Jan. 30, 2024. Available at: https://www.on-running.com/en-us/products/cloudspike-1500m-3md1065/mens/undyed-white-mint-shoes-3MD10651105.

Under Armour Sprint Pro 3 Track Spikes. Under Armour. Publication date not available. Available at: https://www.underarmour.com/us/p/track_and_field/unisex_ua_sprint_pro_3_track_spikes/3022516.html? (accessed Jul. 18, 2024).

* cited by examiner

ATHLETIC SYSTEMS

FIELD

The present invention relates in general to articles of footwear, and more particularly, to support systems in articles of footwear with bladder elements.

BACKGROUND

This section provides background information related to the present disclosure which is not necessarily prior art.

Articles of footwear can include sole structures with support systems that enhance the performance of the article and/or the comfort of the wearer. Continued improvements in support systems for articles of footwear are desirable.

BRIEF DESCRIPTION OF THE DRAWINGS

The detailed description of the invention will be described in relation to the accompanying drawings. In the drawings, the following figures have the following general nature.

Corresponding reference numerals indicate corresponding parts throughout the several views of the drawings.

DETAILED DESCRIPTION

Figure 1:
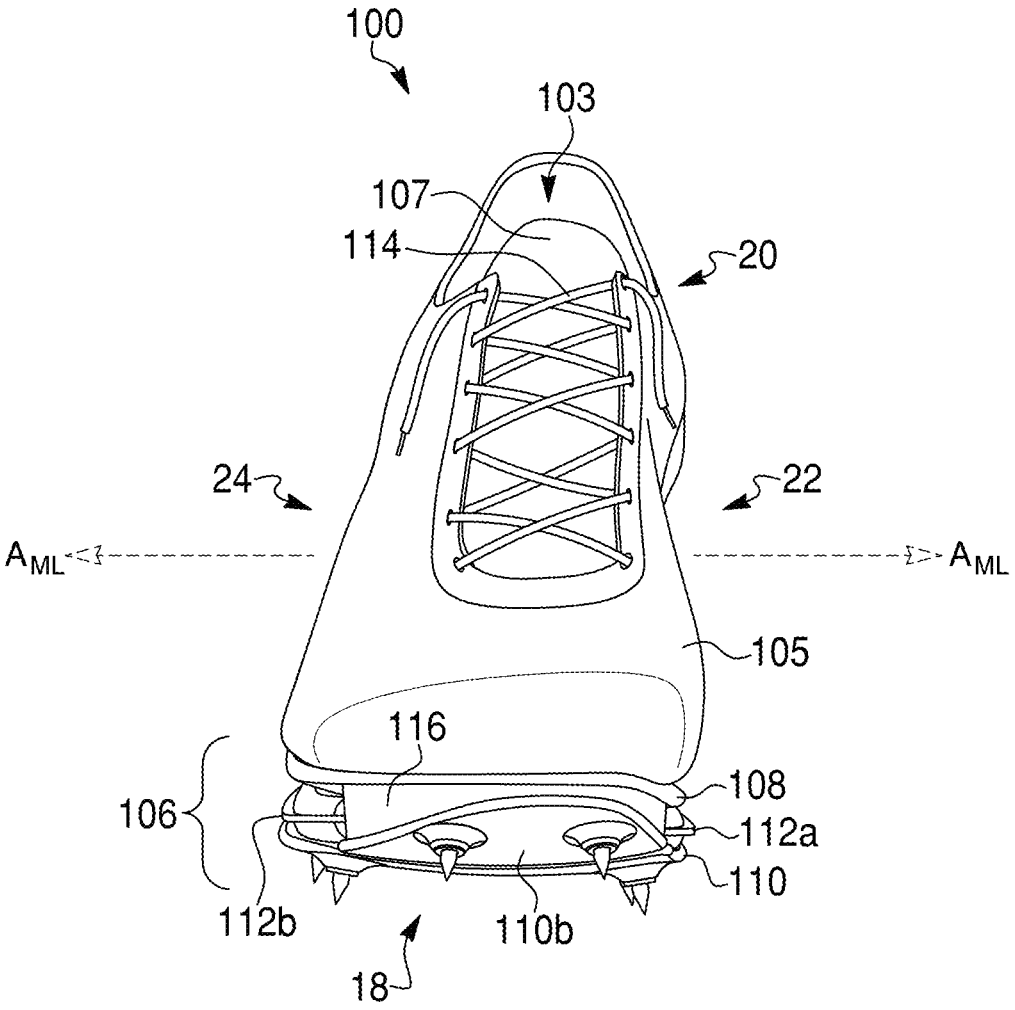
FIG. 1 is a front view of an article of footwear.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about," "approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to a user's foot anatomy when the article of footwear is being worn by a user. The user is considered to be standing on a flat, level surface.

The subject matter of embodiments of the present disclosure is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly stated.

Articles of footwear include different types of shoes, sandals, boots, heels, or the like. For the sake of clarity, articles of footwear will be discussed herein as shoes; however, embodiments are not limited solely to shoes. The technology disclosed herein may equally be used to create footwear other than shoes. To alleviate confusion and to provide a more readable disclosure, embodiments simply reference shoes. To that end and to provide a robust disclosure, different component portions of shoes are discussed herein, including uppers, midsoles, and outsoles. One skilled in the art will understand that shoes may include an upper and a sole structure, with the latter comprising an outsole, a midsole, and perhaps an insole.

FIG. 1 depicts an article of footwear 100. Although a single article of footwear 100 is shown and described herein, it should be appreciated that a pair of articles of footwear 100 may be included (e.g., a left article of footwear and a right article of footwear) without departing from a scope of this disclosure. As such, the description below may be equally applicable to each of the articles of footwear 100. The article of footwear 100 includes an upper 105 coupled to a sole structure 106. The sole structure 106 includes a first plate 108, a second plate 110, and a first cushioning element 112*a* disposed between the first plate 108 and the second plate 110. A second cushioning element 112*b* and a third cushioning element 116 are each disposed between the first plate 108 and the second plate 110. The second plate 110 is an outsole of the article of footwear 100. The second plate 110 is configured to be a ground-engaging or ground-contacting surface of the article of footwear 100. For clarity purposes, the following description is in reference to only one article of footwear of the article of footwear 100.

Portions of the sole structure 106 and the corresponding article of footwear 100 may be identified based on regions of a user's foot located at or near that portion of the article of footwear 100 when worn on the proper foot. For example, the article of footwear 100 is divided into a forefoot region, a mid-foot region, and a heel region. The forefoot region includes a toe portion corresponding to the phalanges of the foot, and a ball portion corresponding to a metatarsophalangeal (MTP) joint. The mid-foot region corresponding with an arch area of the foot. The heel region corresponding with rear portions of the foot, including a calcaneus bone. The article of footwear 100 includes an anterior end 18 including a forward-most point of the forefoot region, and a posterior end 20 including a rearward-most point of the heel region. For ease of discussion, the article of footwear 100 is discussed with reference to a longitudinal axis $A_L$ (shown in FIG. 2), a medial-lateral axis $A_{ML}$, and a vertical axis Av (FIG. 2), where the longitudinal axis $A_L$, the medial-lateral axis $A_{ML}$, and the vertical axis Av are perpendicular to each other. The longitudinal axis $A_L$ of the article of footwear 100 extends along a length of the respective article of footwear 100 from the anterior end 18 to the posterior end 20, and generally divides the respective article of footwear 100 into a medial side 22 and a lateral side 24. The medial-lateral axis $A_{ML}$ extends from medial side 22 to lateral side 24. Accordingly, the medial side 22 and the lateral side 24 respectively correspond with opposing sides of the respective article of footwear 100 and extend from the anterior end 18 to the posterior end 20. The vertical axis Av extends from a bottom (e.g., ground-contacting portion) of the article of footwear 100 to a top of the article of footwear 100.

Still referring to FIG. 1, the upper 105 includes interior surfaces that define an interior void configured to receive and secure a user's foot for support on sole structure 106. The upper 105 may be formed from one or more materials that are stitched, knitted, woven, adhesively bonded, or otherwise joined together to form the interior void. Suitable materials of the upper 105 may include, but are not limited to, mesh, textiles, foam, leather, and synthetic leather. The materials are configured and located to impart properties of durability, air-permeability, wear-resistance, flexibility, and/or comfort.

In some examples, the upper 105 includes a strobel (not shown) having a bottom surface opposing the sole structure 106, and an opposing top surface defining a footbed of the interior void. Stitching or adhesives secure the strobel to the upper 105. The footbed is contoured to conform to a profile of the bottom surface (e.g., plantar) of the foot. Optionally, the upper 105 may incorporate additional layers such as an insole or sockliner (not shown) that are disposed on the strobel and reside within the interior void of the upper 105 to receive a plantar surface of the foot to enhance the comfort of the article of footwear 100. The upper 105 includes an ankle opening 103 in the heel region 16, which provides access to the interior void of the upper 105. For example, the ankle opening 103 receives a user's foot to secure the foot within the interior void and facilitates entry and removal of the foot from and to the interior void. In some examples, one or more fasteners 114 extend along the upper 105 to adjust a size, shape, configuration, and/or fit of the interior void around the foot, and to accommodate entry and removal of the foot therefrom. The one or more fasteners 114 may include one or more laces, straps, cords, hook-and-loop, pins, or any other suitable type of fastener. The upper 105 can include a tongue portion 107 that extends between the interior void and the fasteners 114.

Sole structure 106 can be configured to provide traction for the article of footwear 100, as well as to provide a support structure that supports the foot of a user during walking, running, jogging, or other ambulatory activities. The configuration of sole structure 106 can vary based on use, including the type of ground surfaces on which the article of footwear 100 are intended to be used (e.g., road surfaces, track surfaces, natural turf, synthetic turf, dirt, and other surfaces).

Figure 2:
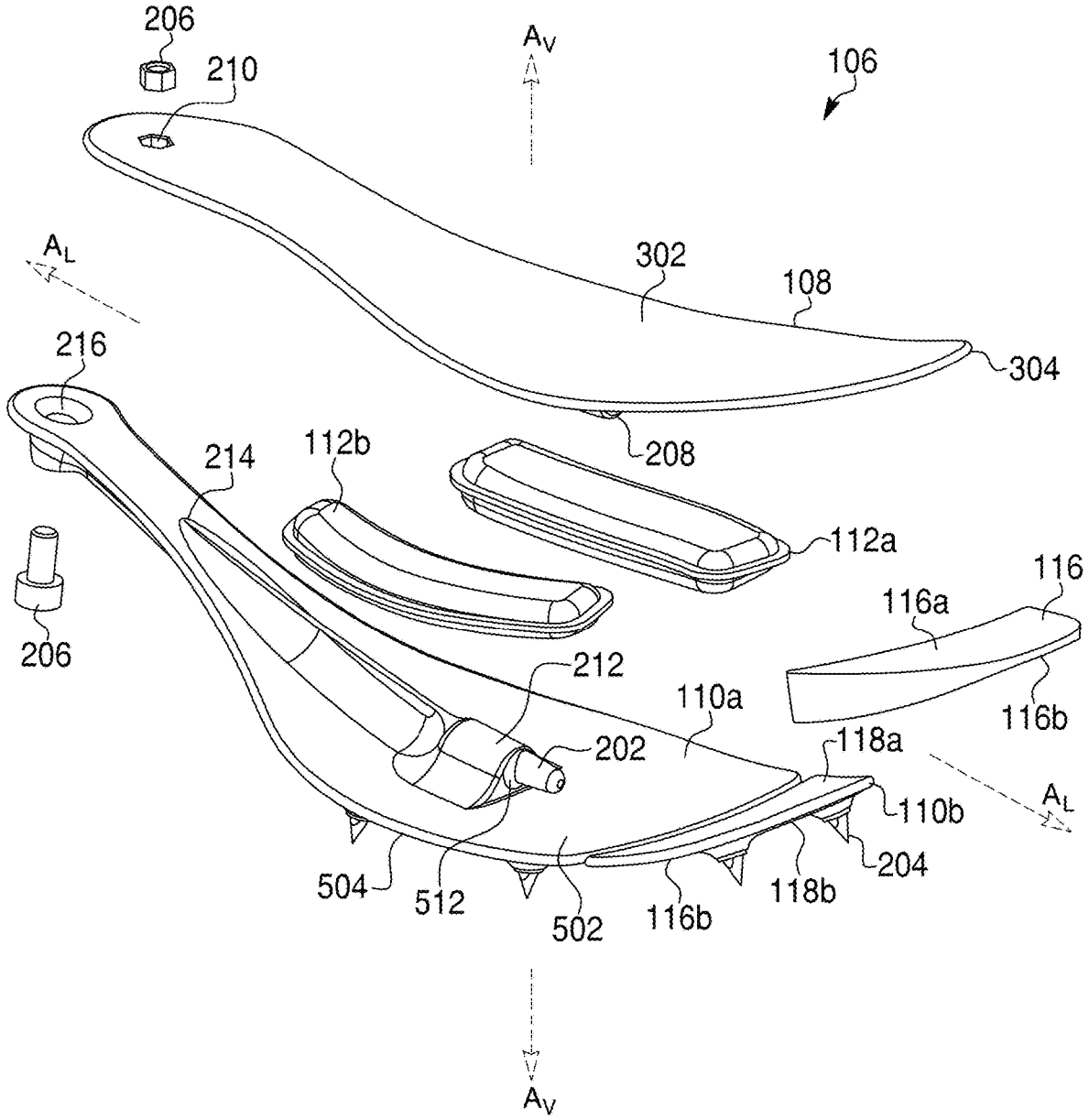
FIG. 2 is an exploded view of a sole structure of the article of footwear of FIG. 1.

FIG. 2 illustrates an exploded view of the sole structure 106 of the article of footwear 100. The sole structure 106 includes the first plate 108, the second plate 110, the first cushioning element 112*a*, the second cushioning element 112*b*, the third cushioning element 116, a pin 202, one or more traction elements 204, and one or more fasteners 206. The first plate 108 includes a first surface 302 and a second surface 304 disposed opposite to the first surface 302. The first plate 108 includes one or more knobs 208 and one or more apertures 210. For example, the first plate 108 includes at least one knob 208 positioned along second surface 304 and at least one aperture 210 extending through the first surface 302 and the second surface 304 at a region of first plate 108 opposite to the at least one knob 208. The at least one knob 208 may extend outwardly (e.g., downwards) from the second surface 304.

In an example, the second plate 110 includes a base plate 110*a* coupled to a support plate 110*b*. The support plate 110*b* is positioned and/or extends longitudinally outwards from the base plate 110*a* in a direction that is parallel to the longitudinal axis $A_L$. In some examples, the base plate 110*a* and the support plate 110*b* form a continuous longitudinal length of the second plate 110. In other examples, the base plate 110*a* and the support plate 110*b* are compositely formed such that they are not in contact with another. The second plate 110 includes a first surface 502 and a second surface 504 disposed opposite to the first surface 502. The second plate 110 includes one or more knobs 212, a fin 214, and one or more apertures 216. For example, at least one knob 212 and the fin 214 are each positioned along and/or extend outwardly (e.g., upwards) from the first surface 502. In the example, the fin 214 contacts, abuts against, and/or is integrally formed with the at least one knob 212. At least one aperture 216 is positioned along an end of the second plate 110 opposite to the third cushioning element 116. The at least one aperture 216 extends through the first surface 502 and the second surface 504. The one or more fasteners 206 may include pins, bolts, nuts, or any other suitable type of fastener. The first plate 108 is disposed adjacent to the upper 105 (shown in FIG. 1) when the sole structure 106 is coupled thereto. The second plate 110 forms a ground-engaging surface of the footwear 100. The first plate 108 is disposed near the upper 105 relative to the second plate 110 when the sole structure 106 is coupled to the upper 105. As will be described in greater detail herein and shown in FIG. 6, the pin 202 and the one or more fasteners 206 connect the first plate 108 with the second plate 110 to allow the sole structure 106 to move relative to the medial-lateral axis $A_{ML}$.

Figure 3:
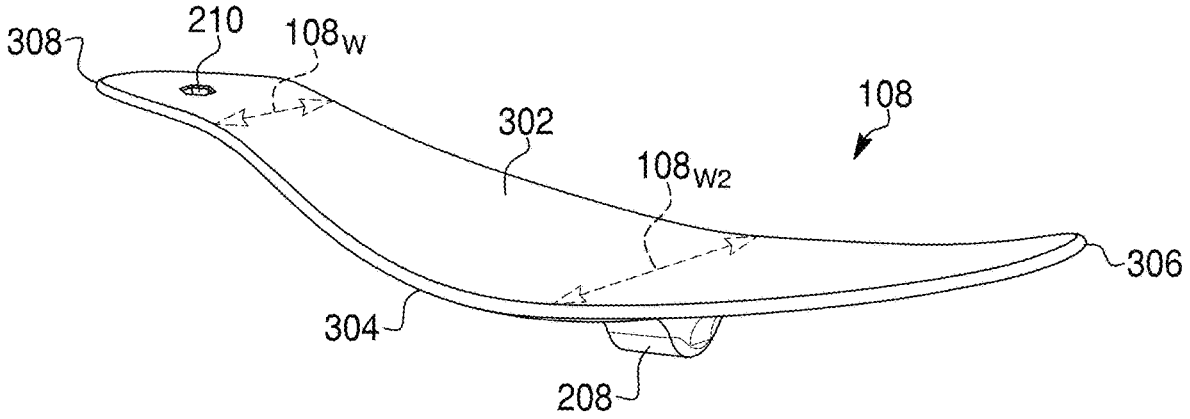
FIG. 3 is a perspective view of a first plate of the sole structure of FIG. 2.

FIG. 3 illustrates a perspective view of the first plate 108. The first plate 108 includes a first (anterior) end 306 and a second (posterior) end 308. The first end 306 is disposed at the anterior end 18 of the sole structure 106 (see FIG. 1). The second end 308 is disposed at the posterior end 20 of the sole structure 106 (see FIG. 1). The one or more apertures 210 are disposed through the first surface 302 and the second surface 304, and each aperture 210 is sized, shaped, and/or otherwise configured to receive at least one fastener 206.

In examples, the first plate 108 has a variable width. In an example, the first plate 108 includes a first width $\mathbf{108}_W$. The first width $\mathbf{108}_W$ is a width of a narrow portion of the first plate 108. The narrow portion of the first plate 108 corresponds with rear portions of the first plate 108 adjacent to the second end 308. In other words, the narrow portion of the first plate 108 is disposed in the heel region of the sole structure 106. In an example, the first plate 108 includes a second width $\mathbf{108}_{W2}$. The second width $\mathbf{108}_{W2}$ is a width of a wide portion of the first plate 108. The wide portion of the first plate 108 corresponds with forward portions of the first plate 108 adjacent to the first end 306. In other words, the wide portion of the first plate 108 is disposed in the forefoot region of the sole structure 106. In an example, the first width $\mathbf{108}_W$ is smaller than the second width $\mathbf{108}_{W2}$. In some examples, about 50% of the first plate 108 has a first width that is the first width $\mathbf{108}_W$ and about 50% of the first plate 108 has a second width that is the second width $\mathbf{108}_{W2}$. In some examples, between about 10% to about 60% of the first plate 108 has a first width that is the first width $\mathbf{108}_W$ and about 40% to about 90% of the first plate 108 has a second width that is the second width $\mathbf{108}_{W2}$.

The first surface 302 of the first plate 108 may be coupled to the upper 105 (see FIG. 1) via adhesive (e.g., glue, wet cement bonding, stitching, or the like. The second surface 304 faces a ground surface. The second surface 304 also faces the first surface 502 of the second plate 110. The one or more apertures 210 may be disposed adjacent to the posterior end 308.

The one or more knobs 208 extend outwardly (e.g., downwards) from the second surface 304 toward a ground surface (not shown). The one or more knobs 208 each include an opening 312. The one or more knobs 208 are disposed near the anterior end 306 relative to the posterior end 308. In another example, the one or more knobs 208 are disposed along a longitudinal center of the second surface 304 between the anterior end 306 and the posterior end 308. In an example, the one or more knobs 208 are rounded. In other examples, the one or more knobs 208 may be triangular, square, hexagonal, or any other suitable shape.

Figure 4:
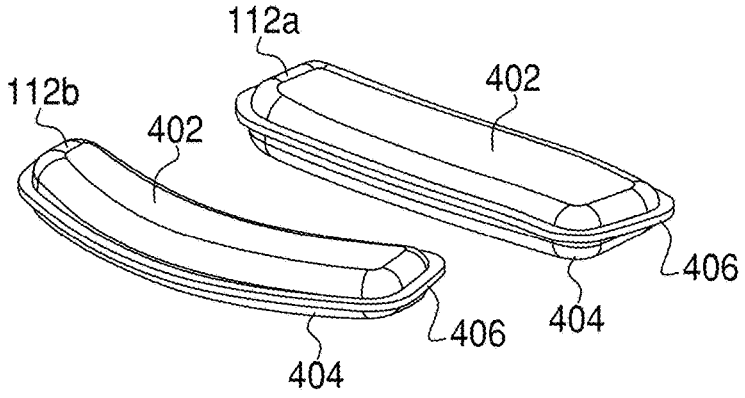
FIG. 4 is a perspective view of a cushioning element of the sole structure of FIG. 2.

FIG. 4 illustrates a perspective view of the cushioning elements 112*a*, 112*b*. The cushioning elements 112*a*, 112*b* may each be a fluid-filled bladder, for example, that may be inflated and/or deflated to provide a desired form of cushioning and support to a foot of a user, as well as a desired form of shock absorption to the foot of the user during use of the article of footwear 100. Cushioning elements 112*a*, 112*b* may be formed from a pair of barrier layers 402, 404, which when joined together may define an enclosed inner volume (or hollow interior) for receiving, for example, a pressurized fluid (e.g. a gas). The barrier layers 402, 404 may be joined to each other at discrete locations to define an overall shape of the cushioning elements 112*a*, 112*b*. In an exemplary embodiment, each of the cushioning elements 112*a*, 112*b* may include a first, upper barrier layer 402 and a second, lower barrier layer 404. The upper barrier layer 402 may be attached to the lower barrier layer 404 by applying heat and/or pressure at a perimeter of the upper barrier layer 402 and the lower barrier layer 404 to define a peripheral seam 406. The peripheral seam 406 may seal the cushioning elements 112*a*, 112*b* together, and may define a peripheral profile of the cushioning elements 112*a*, 112*b*. In an example, the peripheral seam 406 extends radially outward from an exterior surface of the barrier layers 402, 404.

As used herein, the term "barrier layer" (e.g., barrier layers 402, 404) may encompass both monolayer and multilayer films. In some embodiments, one or both of barrier layers 402, 404 may each be produced (e.g., thermoformed or blow molded) from a monolayer film (a single layer). In other embodiments, one or both of barrier layers 402, 404 may each be produced (e.g., thermoformed or blow molded) from a multilayer film (multiple sublayers). In either embodiment, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers. It is contemplated that the cushioning elements 112*a*, 112*b* may have a thickness ranging from about 6 mm to about 10 mm, although other suitable values are contemplated. In an exemplary embodiment, cushioning elements 112*a*, 112*b* may have a thickness of about 8 mm.

One or both of barrier layers 402, 404 may be independently transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 402, 404 may each be produced from an elastomeric material that includes one or more thermoplastic polymers and/or one or more cross-linkable polymers. In an embodiment, the elastomeric material can include one or more thermoplastic elastomeric materials, such as one or more thermoplastic polyurethane (TPU) copolymers, one or more ethylene-vinyl alcohol (EVOH) copolymers, and the like.

The cushioning elements 112*a*, 112*b* may be produced from the barrier layers 402, 404 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an embodiment, the barrier layers 402, 404 can be produced by co-extrusion followed by vacuum thermoforming to produce cushioning elements 112*a*, 112*b*, which can optionally include one or more valves (e.g., one-way valves) that allow cushioning elements 112*a*, 112*b* to be filled with a fluid (e.g., gas).

The cushioning elements 112*a*, 112*b* may be provided in a fluid-filled state or in an unfilled state. The cushioning elements 112*a*, 112*b* are configured and/or biased to return to its original shape via restorative forces present in the cushioning element 112*a*, 112*b* from either the fluid present therein or the natural elasticity of the upper barrier layer 402 and the lower barrier layer 404. The cushioning elements 112*a*, 112*b* may be filled to include any suitable fluid, such as a gas or liquid. In an embodiment, the gas may include air, nitrogen (N2), or any other suitable pressurized fluid. In other embodiments, the cushioning elements 112*a*, 112*b* may alternatively include other media, such as pellets, beads, ground recycled material, and the like (e.g., foamed beads and/or rubber beads). Each of the cushioning elements 112*a*, 112*b* may become pressurized upon receiving a fluid within the respective enclosed inner volume defined by the corresponding barrier layers 402, 404. In some examples, the cushioning elements 112*a*, 112*b* may have a pressure ranging from about 15 psi (pounds per square inch) to about 25 psi. In other examples, the cushioning elements 112*a*, 112*b* may have a pressure ranging from about 20 psi to about 25 psi. In some examples, the cushioning elements 112*a*, 112*b* may have a pressure of about 20 psi. In other examples, the cushioning elements 112*a*, 112*b* may have a pressure of about 25 psi. Alternatively, the fluid provided to the cushioning elements 112*a*, 112*b* may be at atmospheric pressure such that the cushioning elements 112*a*, 112*b* is not pressurized but, rather, simply contains a volume of fluid at atmospheric pressure.

In an embodiment, the cushioning elements 112*a*, 112*b* have a low gas transmission rate to preserve a gas pressure retained within the respective enclosed inner volumes of each cushioning element 112*a*, 112*b*. In some embodiments, cushioning elements 112*a*, 112*b* may have a gas transmission rate for nitrogen gas that is at least about ten (10) times lower than a nitrogen gas transmission rate for a butyl rubber layer of substantially the same dimensions. In an embodiment, cushioning elements 112*a*, 112*b* may have a nitrogen gas transmission rate of about 15 cubic-centimeter/square-meter. atmosphere. day ($cm^3/m^2 \cdot atm \cdot day$) or less for an average film thickness of about 500 micrometers (based on thicknesses of barrier layers 402, 404). In further embodiments, the transmission rate may be about 10 $cm^3/m^2 \cdot atm \cdot day$ or less, about 5 $cm^3/m^2 \cdot atm \cdot day$ or less, or about 1 $cm^3/m^2 \cdot atm \cdot day$ or less.

In the example, cushioning elements 112*a*, 112*b* may be substantially rectangular. The cushioning elements 112*a*, 112*b* are each configured to abut against respective surfaces of the first plate 108 and the second plate 110. For example, the upper barrier layer 402 contacts the second surface 304 of the first plate 108. The lower barrier layer 404 contacts the first surface 502 of the second plate 110. In other examples, the cushioning elements 112*a*, 112*b* may be circular, ovular, irregular, or any other shape suitable for providing a desired form of cushioning, stability, or support.

In some examples, the cushioning elements 112*a*, 112*b* may be sized, shaped, and/or otherwise configured to receive one or more tensile elements (not shown) therein. Each tensile element may include a series of tensile strands extending between an upper tensile sheet (not shown) and a lower tensile sheet (not shown). The upper tensile sheet may be attached to the upper barrier layer 402 while the lower tensile sheet may be attached to the lower barrier layer 404. In this manner, when each of the cushioning elements 112*a*, 112*b* receives the pressurized fluid, the tensile strands of the tensile element are placed in tension. Because the upper tensile sheet is attached to the upper barrier layer 402 and the lower tensile sheet is attached to the lower barrier layer 404, the tensile strands are configured to retain a desired shape of the cushioning elements 112*a*, 112*b* when the pressurized fluid is injected into the respective fluid-filled chamber of each of the cushioning elements 112*a*, 112*b*.

In an alternative embodiment, cushioning elements 112*a*, 112*b* may include a polymer foam and/or particulate matter in one or more, or all, regions of the cushioning elements 112*a*, 112*b* corresponding to the enclosed inner volume of the cushioning elements 112*a*, 112*b*. For example, the cushioning elements 112*a*, 112*b* may include a plurality of fluid-filled chambers (not shown) arranged in the forefoot region, as described in greater detail below. Additionally or alternatively, the cushioning elements 112*a*, 112*b* may be replaced or supplemented with other cushioning elements. For example, the cushioning element may include one or more foam block(s) that replace or supplement the pressurized fluid received inside the cushioning elements 112*a*, 112*b*. The foam block(s) may be received between the upper barrier layer 402 and the lower barrier layer 404. Positioning the foam block(s) between the upper barrier layer 402 and the lower barrier layer 404 may allow the barrier layers 402, 404 to restrict expansion of the foam block(s) beyond a predetermined amount when subjected to a predetermined load. Accordingly, the overall shape and, thus, the performance of the foam block(s) may be controlled by allowing the foam block(s) to interact with the barrier layers 402, 404 during loading. While the foam block(s) are described as being received between the barrier layers 402, 404, the foam block(s) may alternatively be positioned between the first plate 108 and the second plate 110 absent the barrier layers 402, 404. In such a configuration, the foam block(s) may be directly attached to the second surface 304 of the first plate 108 and the first surface 502 of the second plate 110, respectively.

Figure 5A:
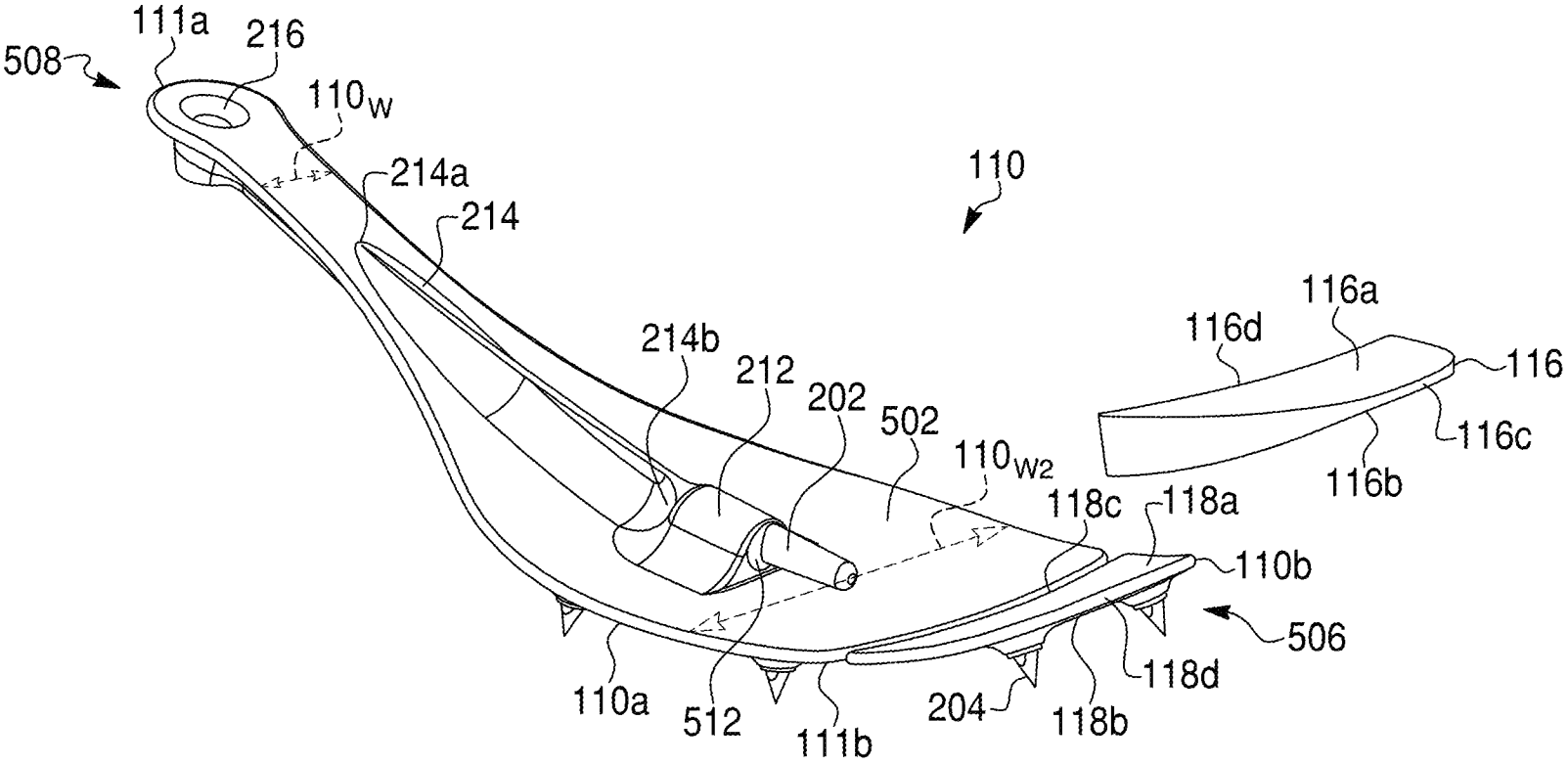
FIG. 5A is a top perspective view of a second plate of the sole structure of FIG. 2.

FIG. 5A illustrates a top perspective view of the second plate 110. The second plate 110 includes a first (anterior) end 506 and a second (posterior) end 508. The first end 506 is disposed at the anterior end 18 of the sole structure 106 (see FIG. 1). The second end 508 is disposed at the posterior end 20 of the sole structure 106 (see FIG. 1). The aperture 216 is disposed through the first surface 502 and the second surface 504. In an example, the second plate 110 is generally pear-shaped. The second plate 110 may be shaped to compliment the shape of the first plate 108. In other examples, the second plate 110 may have a generally consistent shape. The second plate 110 may be shaped in any manner to provide a desired form of cushioning and support to a foot of a user of the article of footwear 100. As will be described in further detail below, the second plate 110, particularly adjacent the second end 508, is configured to operate as a torsion bar suspension for the sole structure 106.

In examples, the second plate 110 has a variable width. In an example, the second plate 110 includes a first width $\mathbf{110}_W$. The first width $\mathbf{110}_W$ is a width of a narrow portion of the second plate 110. The narrow portion of the second plate 110 corresponds with rear portions of the second plate 110 adjacent to the second end 508. In other words, the narrow portion of the second plate 110 is disposed in the heel region of the sole structure 106. In an example, the second plate 110 includes a second width $\mathbf{110}_{W2}$. The second width $\mathbf{110}_{W2}$ is a width of a wide portion of the second plate 110. The wide portion of the second plate 110 corresponds with forward portions of the second plate 110 adjacent to the first end 506. In other words, the wide portion of the second plate 110 is disposed in the forefoot region of the sole structure 106. In an example, the first width $\mathbf{110}_W$ is smaller than the second width $\mathbf{110}_{W2}$. In some examples, about 50% of the second plate 110 has a first width that is the first width $\mathbf{110}_W$ while about 50% of the second plate 110 has a second width that is the second width $\mathbf{110}_{W2}$. In some examples, between about 10% to about 60% of the second plate 110 has a first width that is the first width $\mathbf{110}_W$ while about 40% to about 90% of the second plate 110 has a second width that is the second width $\mathbf{110}_{W2}$.

The first surface 502 of the second plate 110 faces the second surface 304 of the first plate 108 when the sole structure 106 is assembled. The second surface 504 faces a ground surface (not shown). The second surface 504 includes the one or more traction elements 204. The one or more traction elements 204 extend from the second surface 504 toward a ground surface. The second surface 504 and the traction elements 204 form a ground-engaging surface of the article of footwear 100. The one or more apertures 216 extend through the first surface 502 and the second surface 504. The one or more apertures 216 may be disposed adjacent the posterior end 508.

The base plate 110*a* has a longitudinal length that extends from a first end 111*a* disposed adjacent to the posterior end 508 towards a second end 111*b* disposed adjacent to the support plate 110*b*. The support plate 110*b* includes a first surface 118*a* and a second surface 118*b* disposed opposite to the first surface 118*a*. The first surface 118*a* faces the first plate 108 when the sole structure 106 is assembled and the second surface 118*b* faces a ground surface (not shown). The support plate 110*b* has a longitudinal length that extends from a first end 118*c* disposed adjacent to the second end 111*b* of the base plate 110*a* towards a second end 118*d* disposed adjacent to the anterior end 506 of the second plate 110.

The one or more knobs 212 extend outwards (e.g., upwards) from the first surface 502 towards the second surface 304 of the first plate 108 when the sole structure 106 is fully assembled. The one or more knobs 212 include an opening 512. The one or more knobs 212 are disposed on the second plate 110 near the anterior end 506 relative to the posterior end 508. In an example, the one or more knobs 212 are rounded. In other examples, the one or more knobs 212 may be triangular, square, hexagonal, or any other shape.

The pin 202 is configured to extend through and is disposed within the opening 512. The pin 202 is held within the knob 212 by a fastener or mechanical fit. The pin 202 is substantially cylindrical in shape. In some examples, the pin 202 may be hexagonal, conical, triangular, or any other shape suitable for extending through the opening 512. The pin 202 is configured to rotate within the knob 212. In some examples, the pin 202 is secured within the knob 212 while disposed through the opening 512. The pin 202 forms a rotation point for the sole structure 106.

The fin 214 extends outwardly (e.g., upwards) from and along the first surface 502. The fin 214 has a longitudinal length that extends from a first end 214*a* that is positioned adjacent to the second end 508, to a second end 214*b* that is positioned adjacent to the knob 212. In some examples, the fin 214 is disposed centrally along the first surface 502 between opposing outer edges of the second plate 110. The fin 214 is sized, shaped, and/or otherwise configured to define a sloped ramp along the first surface 502. For example, the fin 214 includes a central portion that is elevated relative to peripheral portions of the fin 214 and the first surface 502 of the second plate 110. In an example, a cross-sectional profile of the fin 214 follows the general curvature of the first surface 502. In some examples, the fin 214 is positioned with the inner boundary of the first surface 502. The fin 214 may be positioned anywhere along the first surface 502 as desired to aid medial and lateral movement of the first plate 108. For example, the fin 214 is sized, shaped, and/or otherwise configured to provide a fulcrum on the second plate 110.

The third cushioning element 116 is disposed adjacent to the anterior end 506. In an example, the third cushioning element 116 is a foamed element. The third cushioning element 116 includes a first surface 116*a* and a second surface 116*b* (shown in FIG. 5B) that is opposite of the first surface 116*a*. The third cushioning element 116 includes a first end 116*c* that is generally rounded, and a second end 116*d* (shown in FIG. 5B) that is generally flat relative to the first end 116*c*. The first surface 116*a* faces the second surface 304 of the first plate 108 when the sole structure 106 is fully assembled and the second surface 116*b* faces the ground surface (not shown). The first surface 116*a* is configured to be coupled to the first plate 108 via adhesive (e.g., glue, wet cement bonding, or the like). The second surface 116*b* is configured to be coupled to the second plate 110 via adhesive (e.g., glue, wet cement bonding, or the like). The third cushioning element 116 is configured to moderate medial and lateral movements of the first plate 108 relative to the second plate 110. In other words, the third cushioning element 116 limits the movement of the first plate 108 relative to the second plate 110.

Figure 5B:
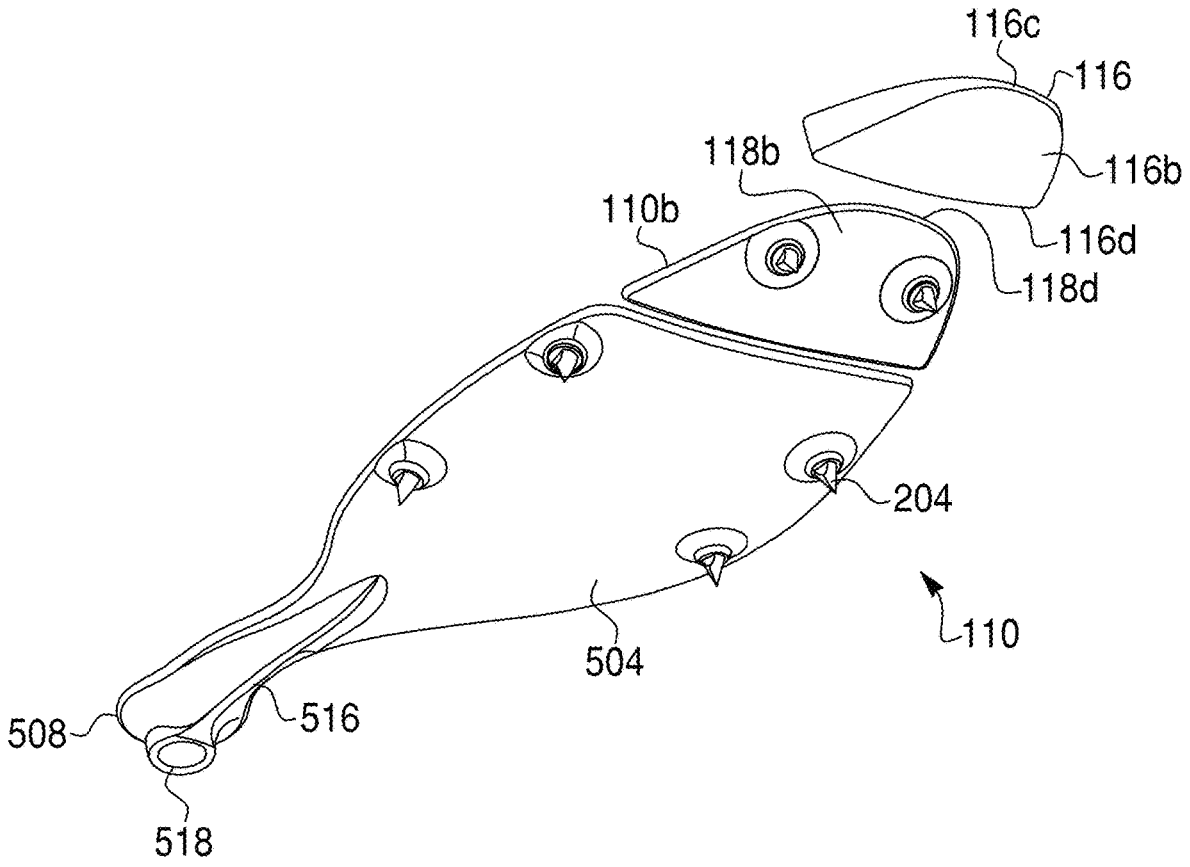
FIG. 5B is a bottom perspective view of the second plate of FIG. 5A.

Referring to FIG. 5B, a bottom perspective view of the second plate 110 is shown. The second surface 504 includes a support structure 516 and a protrusion 518. The protrusion 518 and the support structure 516 are each disposed adjacent to the second end 508. The protrusion 518 and the support structure 516 each extends outwardly away (e.g., downwards) from the second surface 504. The support structure 516 is positioned on and/or extends outwardly away from the second surface 504, such as in a downwards direction from an exterior of the second surface 504. Support structure 516 is disposed adjacent to the second end 508. The aperture 216 extends through the protrusion 518. The one or more traction elements 204 extend outwardly (e.g., downwards)

from the second surface 504. In some examples, the one or more traction elements 204 are permanently affixed to the second surface 504. In other examples, the one or more traction elements 204 are configured to be removed from the second plate 110 and replaced. For example, the one or more traction elements 204 are spikes that are configured and operable to engage, contact, pierce, and/or otherwise interface with a ground surface (not shown) that the article of footwear 100 is positioned and/or received on during use to enhance a traction and controlled movability for the user.

Figure 6:
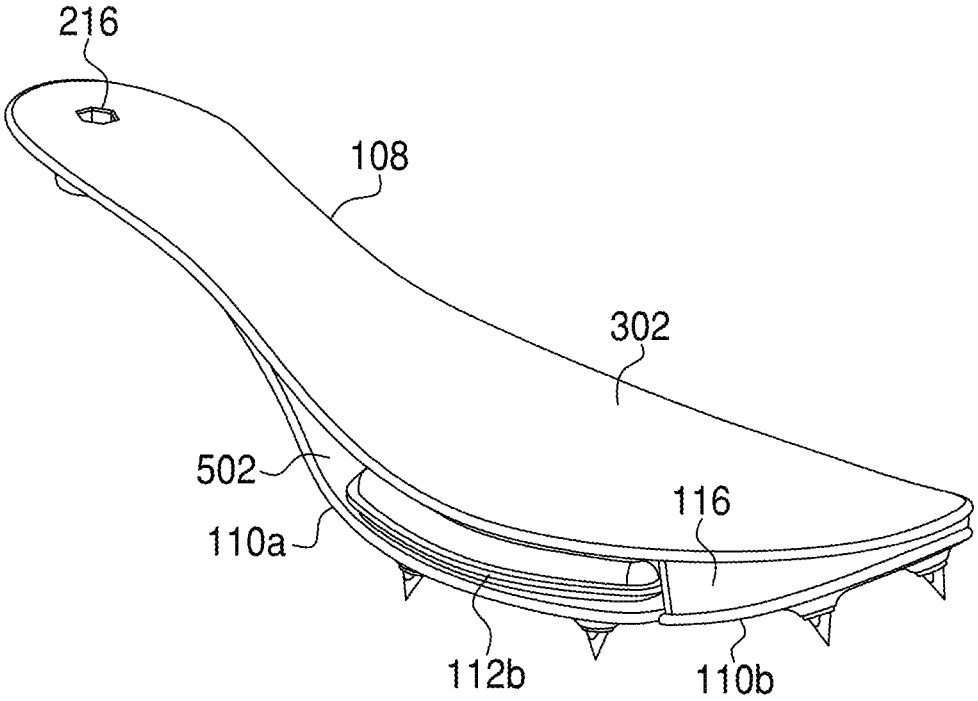
FIG. 6 is a perspective view of the sole structure of FIG. 2.

FIG. 6 shows the sole structure 106 in its fully assembled configuration with the first plate 108 and the second plate 110 coupled to one another along various connection points. The aperture 216 of the second plate 110 (not shown) is aligned with the aperture 210 of the first plate 108. The sole structure 106 includes a first fastening mechanism (e.g., a bolt, a nut, etc.) that is disposed through the aperture 216 and the aperture 210, and secured by the one or more fasteners 206 (not shown), to securely couple the first plate 108 to the second plate 110. This alignment and securement provides a secure connection between the first plate 108 and the second plate 110 at a location adjacent to the posterior end 20. The connection of the first plate 108 and the second plate 110 adjacent to the posterior end 20 is not fixed, but is secure to allow for minimal movement of the first plate 108 relative to the second plate 110.

The first plate 108 and the second plate 110 are affixed to the third cushioning element 116. The first plate 108 and the second plate 110 may be fixed to the third cushioning element 116 via an adhesive (e.g., glue). This alignment and connection by the third cushioning element 116 provides a coupling between the first plate 108 and the second plate 110 adjacent to the anterior end 18. The connection of the first plate 108 and the second plate 110 via the third cushioning element 116 adjacent to the anterior end 18 allows for movement of the first plate 108 relative to the second plate 110 at the anterior end 18. The connection of the first plate 108 and the second plate 110 adjacent to the posterior end 20 provides an anterior pivot point for the first plate 108 relative to the second plate 110. For example, the fastening between the aperture 210 and the aperture 216 forms the anterior pivot point for the first plate 108 relative to the second plate 110. The anterior pivot point allows the first plate 108 to move laterally relative to the second plate 110.

When the first plate 108 and the second plate 110 are coupled to one another, the pin 202 extends through the one or more knobs 212 of the second plate 110 and the one or more knobs 208 of the first plate 108. In an example, the pin 202 is configured to rotate within each of the one or more knobs 208, 212. The connection of the pin 202 within the one or more knobs 208, 212 provides a central attachment point between the first plate 108 and the second plate 110 of the article of footwear 100. The central attachment between the first plate 108 and the second plate 110 allows a high degree of freedom of relative movement of the first plate 108 relative to the second plate 110. In an example, the first plate 108 is allowed a high degree of movement when moving (e.g., pivoting) laterally or medially relative to the second plate 110.

As seen in FIG. 1, the first cushioning element 112*a* is disposed adjacent to the medial side 22 between the first plate 108 and the second plate 110. The second cushioning element 112*b* is disposed adjacent to the lateral side 24 between the first plate 108 and the second plate 110. This connection of the pin 202 within the one or more knobs 208, 212 allows the sole structure 106 to move (e.g., pivot) towards the medial side 24 and the lateral side 24 onto the respective cushioning elements 112*a*, 112*b*. The aforementioned connection of the first plate 108 allows the first plate 108 to rock to either side of the article of footwear 100, thus providing a desired form of stability in either direction of the article of footwear 100.

As will be described herein, to provide a banking angle relative to a ground surface shown in FIG. 7A, the first cushioning element 112*a* positioned on the medial side 22 and the second cushioning element 112*b* of a second article of footwear, when worn as a pair of article of footwear 100, is positioned on the lateral side 24, as shown in FIG. 1. The banking angle is an angle formed along the second surface 304 of the first plate 108 relative to the ground surface when the user of the article of footwear 100 is, for example, turning around a corner on a track.

Figure 7A:
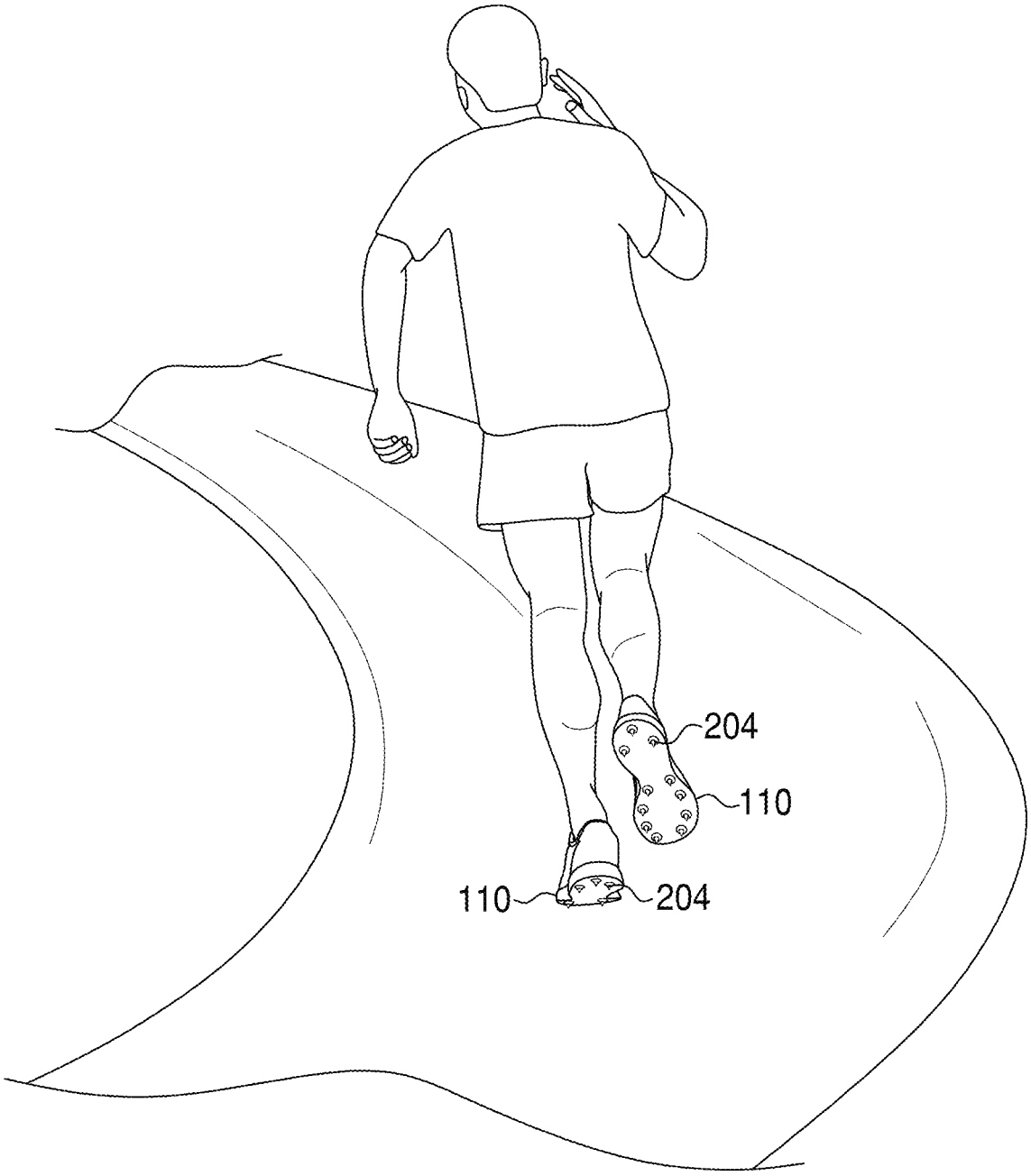
FIG. 7A is an exemplary view of a user wearing the article of footwear of FIG. 1.
Figure 7B:
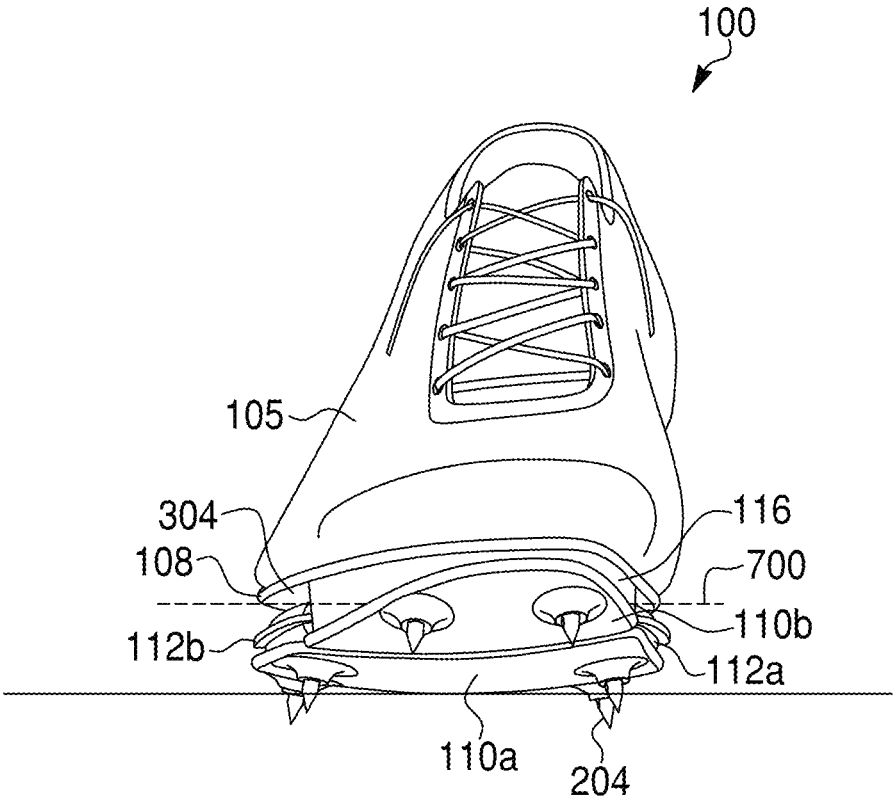
FIG. 7B is a front view of the article of footwear of FIG. 1 in a first configuration.
Figure 7C:
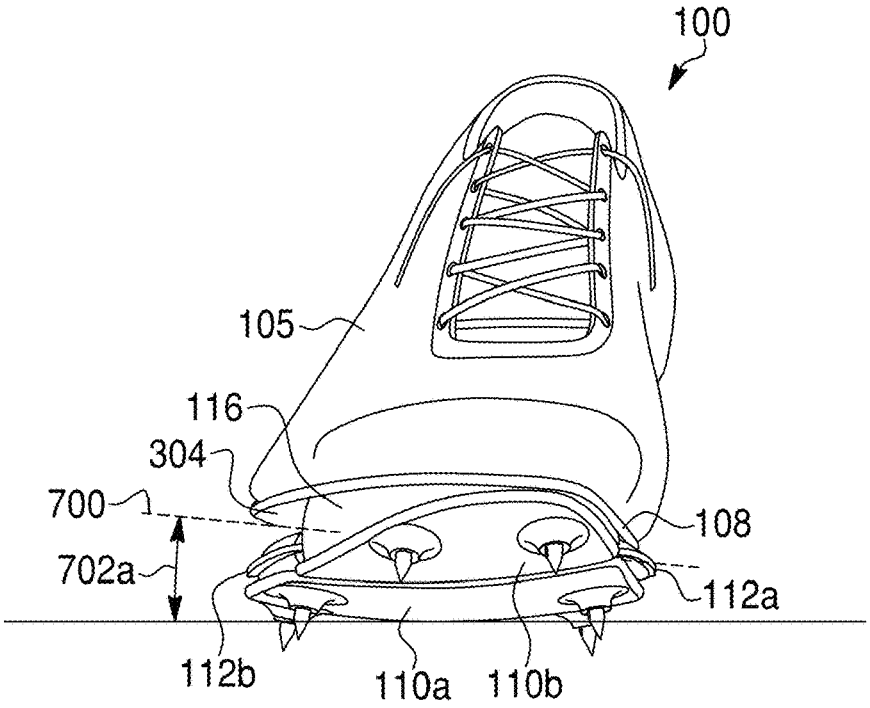
FIG. 7C is a front view of the article of footwear of FIG. 1 in a second configuration.
Figure 7D:
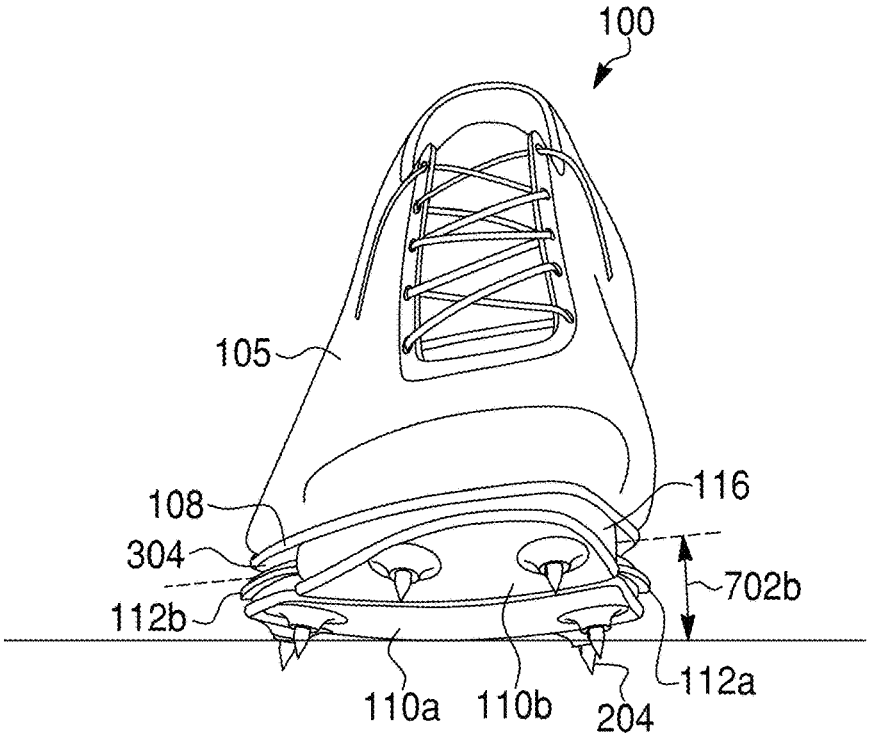
FIG. 7D is a front view of the article of footwear of FIG. 1 in a third configuration.

FIGS. 7A-7D show a banking angle that is variable (i.e., changing) for the articles of footwear 100. FIG. 7A shows a user of the article of footwear 100 banking while using the articles of footwear 100. As shown in FIG. 7B, a neutral position of the article of footwear 100 is shown, such as when the user is moving (e.g., walking, jogging, running, etc.) in a generally straight direction with a plane 700 extending along the second surface 304 of the first plate 108 being substantially parallel with the ground surface 600. In the neutral position, the article of footwear 100 is substantially parallel to the ground surface 600 and has a minimum banking angle, which in some examples will be approximately zero or a zero-banking angle. In an example, as shown in FIG. 7C, a first banked position of the article of footwear 100 is shown when the user is moving (e.g., walking, jogging, running, etc.) along a bank (e.g., a sloped surface on a track) and the article of footwear 100 tilts to form a first angle 702*a* (e.g., a banking angle) between the ground surface 600 and the plane 700. As the user moves along a banked surface, the user's weight moves (e.g., pivots, shifts, tilts, etc.) the first plate 108 onto the cushioning element 112*a*. The cushioning element 112*a* may be compressed to a maximum compression limit of the cushioning element 112*a*. In an example, as shown in FIG. 7D, a second banked position of the article of footwear 100 is shown when the user is coming out of a bank along a straight path and the article of footwear 100 tilts to form a second angle 702*b* (i.e., the banking angle) between the ground surface 600 and the plane 700. As the user comes out of the bank, the user's weight moves (e.g., pivots) the first plate 108 onto the cushioning element 112*b*. The compression of the cushioning elements 112*a*, 112*b* provide a desired form of stability to the user of the article of footwear 100.

The cushioning elements 112*a*, 112*b* may be compressed to a maximum compression limit of the cushioning elements 112*a*, 112*b*. As the user comes out of the bank, the cushioning elements 112*a*, 112*b* are configured to apply restorative forces to push the first plate 108 back towards the neutral position shown in FIG. 7B in response to the user exiting the bank and the user's weight shifting. As the first plate 108 returns to the neutral position after banking, the first plate 108 is given the freedom to extend past the neutral position to accommodate shifting of the weight of the user.

In some examples, the cushioning elements 112*a*, 112*b* may be fully compressed to about 100% of the compression limit of the cushioning elements 112*a*, 112*b*. In some examples, the cushioning elements 112*a*, 112*b* may be partially compressed to any percentage of the compression limit of the cushioning elements 112*a*, 112*b* corresponding to the force applied by the user of the article of footwear 100. In some examples, the cushioning elements 112*a*, 112*b* may be partially compressed to about 75% of the compression limit of the cushioning elements 112*a*, 112*b*. In some examples, the cushioning elements 112*a*, 112*b* may be partially compressed to about 50% of the compression limit of the cushioning elements 112*a*, 112*b*. In some examples, the cushioning elements 112*a*, 112*b* may be partially compressed to about 25% of the compression limit of the cushioning elements 112*a*, 112*b*.

The compression of the cushioning elements 112*a*, 112*b* provides the desired first and second (banking) angles 702*a*, 702*b*, which can vary depending on application. The compression of the cushioning element 112*a* in the medial direction forms the first angle 702*a*. The compression of the cushioning element 112*b* in the lateral direction forms the second angle 702*b*. For example, with a maximum first and second (banking) angle 702*a*, 702*b* of about 20 degrees, the desired banking angle would be able to vary between about 0 and about 20 degrees. In some examples, higher or lower maximum banking angles can be achieved. In some examples, the maximum first and second (banking) angle 702*a*, 702*b* is about 30 degrees. In some examples, the maximum first and second (banking) angle 702*a*, 702*b* is about 50 degrees. In some examples, the maximum first and second (banking) angle 702*a*, 702*b* is about 80 degrees. In some examples, the maximum first and second (banking) angle 702*a*, 702*b* is about 18 degrees. In some examples, the maximum first and second (banking) angle 702*a*, 702*b* is about 15 degrees. In some examples, the maximum first and second (banking) angle 702*a*, 702*b* is about 10 degrees.

Figure 8:
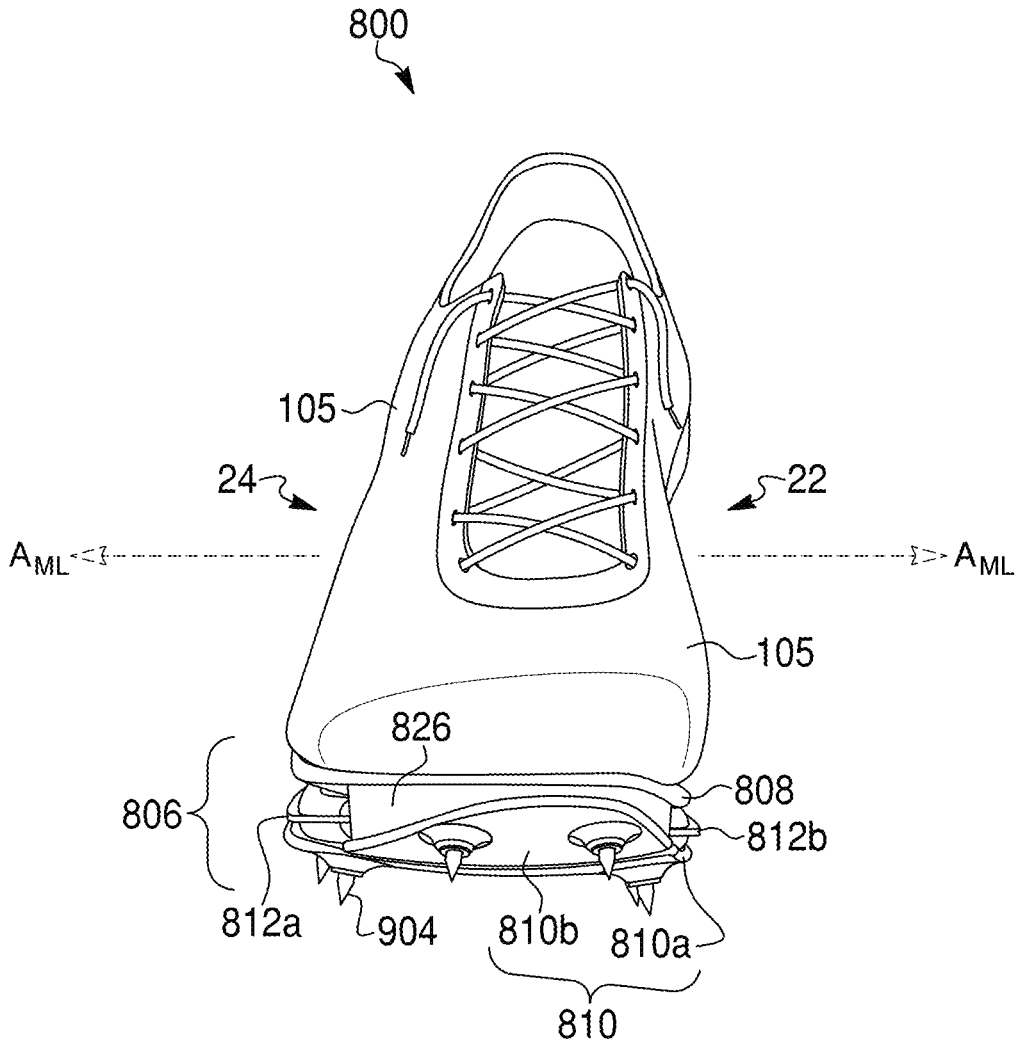
FIG. 8 is a front view of another article of footwear.

FIG. 8 depicts an article of footwear 800. Article of footwear 800 may be substantially similar to article of footwear 100 except as described below. As such, like reference numbers are used to identify similar components. Although a single article of footwear 800 is shown and described herein, it should be appreciated that a pair of articles of footwear 800 may be included (e.g., a left article of footwear and a right article of footwear) without departing from a scope of this disclosure. As such, the description below may be equally applicable to each of the articles of footwear 800. For clarity purposes, the following description is in reference to only one article of footwear of the article of footwear 800. The article of footwear 800 has the upper 105 coupled to a sole structure 806. The sole structure 806 includes a first plate 808, a second plate 810, a first cushioning element 812*a* disposed between the first plate 808 and the second plate 810, and a second cushioning element 812*b* disposed between the first plate 808 and the second plate 810. A third cushioning element 826 is disposed between the first plate 808 and the second plate 810. The second plate 810 is an outsole of the article of footwear 800. The second plate 810 is configured to be a ground-engaging or ground-contacting surface of the article of footwear 800.

Figure 9:
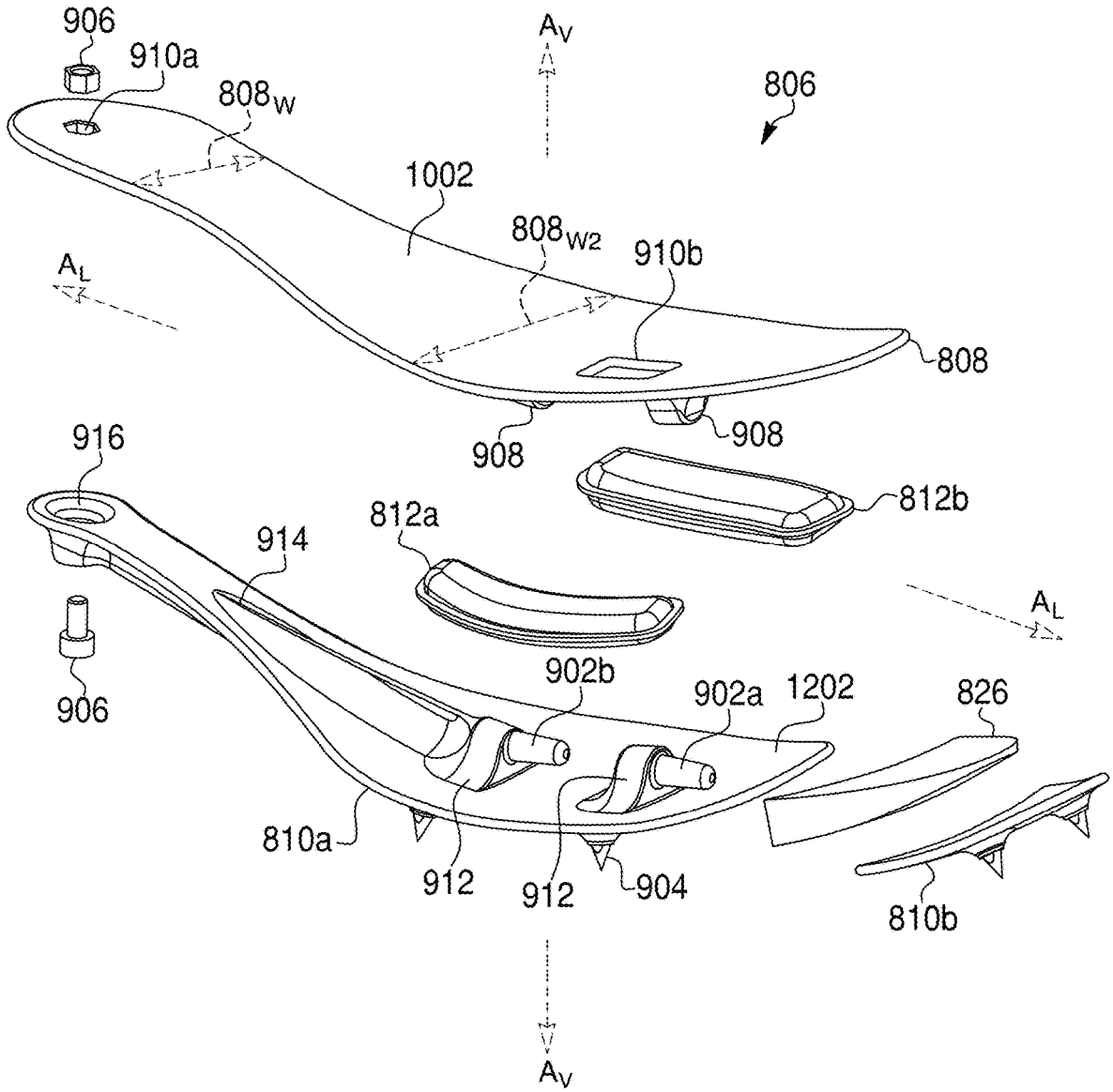
FIG. 9 is an exploded view of a sole structure of the article of footwear of FIG. 8.

FIG. 9 illustrates an exploded view of the sole structure 806 of the article of footwear 800. The sole structure 806 includes a first pin 902*a*, a second pin 902*b*, one or more traction elements 904, and one or more fasteners 906. The first plate 808 includes a first surface 1002 and a second surface 1004 disposed opposite the first surface 1002. The second plate 810 includes a first surface 1202 and a second surface 1204 disposed opposite the first surface 1202. The first plate 808 includes one or more knobs 908*a*, 908*b* (e.g., a pair of knobs), a first aperture 910*a*, and a second aperture 910*b*. The second plate 810 includes one or more knobs 912*a*, 912*b* (e.g., a pair of knobs), a fin 914, and one or more apertures 916. The one or more fasteners 906 may include pins, bolts, nuts, or any other suitable type of fastener. The first plate 808 is disposed adjacent to the upper 105 (shown in FIG. 8) relative to the second plate 810. The second plate 810 forms a ground-engaging surface of the article of footwear 800. The first plate 808 is disposed near the upper 805 relative to the second plate 810. As will be described in greater detail herein and shown in FIGS. 13A-13D, the pins 202*a*, 202*b* and the one or more fasteners 906 are collectively configured to connect the first plate 808 and the second plate 810 to allow for the sole structure 806 to move relative to the medial-lateral axis $A_{ML}$.

Figure 10:
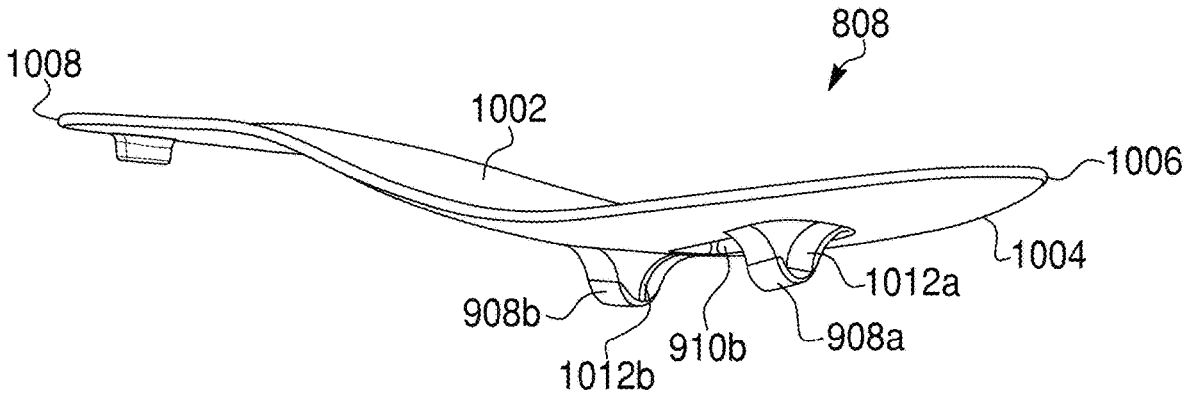
FIG. 10 is a perspective view of a first plate of the article of footwear of FIG. 8.

FIG. 10 illustrates a perspective view of the first plate 808. The first plate 808 includes a first (anterior) end 1006 and a second (posterior) end 1008. The first end 1006 is disposed at the anterior end 18 of the sole structure 806. The second end 1008 is disposed at the posterior end 20 of the sole structure 806. The first aperture 910*a* and the second aperture 910*b* are disposed through the first surface 1002 and the second surface 1004. The first aperture 910*a* is disposed adjacent to the second end 1008. The second aperture 910*b* is disposed adjacent to the first end 1006. The first surface 1002 of the first plate 808 may be coupled to the upper 105 via adhesive (e.g., glue, wet cement bonding, stitching. The second surface 1004 faces a ground surface.

Referring back to FIG. 9, the first plate 808 has a variable width. In an example, the first plate 808 includes a first width $\mathbf{808}_W$. The first width $\mathbf{808}_W$ is a width of a narrow portion of the first plate 808. The narrow portion of the first plate 808 corresponds with rear portions of the first plate 808 adjacent to the second end 1008. In other words, the narrow portion of the first plate 808 is disposed in the heel region of the sole structure 806. In an example, the first plate 808 includes a second width $\mathbf{808}_{W2}$. The second width $\mathbf{808}_{W2}$ is a width of a wide portion of the first plate 808. The wide portion of the first plate 808 corresponds with forward portions of the first plate 808 adjacent to the first end 1006. In other words, the wide portion of the first plate 808 is disposed in the forefoot region of the sole structure 806. In an example, the first width $\mathbf{808}_W$ is smaller than the second width $\mathbf{808}_{W2}$. In some examples, about 50% of the first plate 808 has a first width that is the first width $\mathbf{808}_W$ while about 50% of the first plate 808 has a second width that is the second width $\mathbf{808}_{W2}$. In some examples, between about 10% to about 60% of the first plate 808 has a first width that is the first width $\mathbf{808}_W$ while about 40% to about 90% of the first plate 808 has a second width that is the second width $\mathbf{808}_{W2}$.

The one or more knobs 908*a*, 908*b* extend outwardly (e.g., downwards) from the second surface 1004 toward a ground surface. The one or more knobs 908*a*, 908*b* include a first knob 908*a* and a second knob 908*b*. The first knob 908*a* includes a first opening 1012*a* and the second knob 908*b* includes a second opening 1012*b*. The knobs 908*a*, 908*b* are disposed near the anterior end 1006 relative to the posterior end 1008. In an example, the first knob 908*a* is disposed near the anterior end 1006 relative to the second knob 908*b*. The first knob 908*a* and the second knob 908*b* are positioned in longitudinal alignment with one another along the second surface 1004 such that a center of each of the openings 1012*a*, 1012*b* are coaxial with one another. In an example, each of the knobs 908*a*, 908*b* are rounded. In other examples, the knobs 908*a*, 908*b* may be triangular, square, hexagonal, or any other shape.

In its fully assembled configuration, the first plate 808 and the second plate 810 are coupled to one another along various connection points. The aperture 916 of the second plate 810 is aligned with the aperture 910*a* of the first plate 808 when the sole structure 806 is fully assembled. A first fastening mechanism (e.g., a bolt, a nut, etc.) is disposed through the first aperture 910*a* and the aperture 916, and secured by the one or more fasteners 906. This alignment and securement provides a secure connection between the first plate 808 and the second plate 810 adjacent to the posterior end 20. The first knob 912*a* of the second plate 810 extends through the second aperture 910*b* of the first plate 808 when the first plate 808 is coupled to the second plate 810. This alignment and securement provides a secure connection between the first plate 808 and the second plate 810 adjacent to the anterior end 18.

When the first plate 808 and the second plate 810 are coupled to one another, the first knob 908*a* and the second knob 908*b* are positioned between the first knob 912*a* and the second knob 912*b*. The pin 902*a* is disposed through the first opening 1212*a* of the first knob 912*a* and the first opening 1012*a* of the first knob 908*a*. The pin 902*a* is configured to rotate within each of the first knob 908*a* and the first knob 912*a*. The pin 902*b* is disposed through the second opening 1212*b* of the second knob 912*b* and the second opening 1012*b* of the second knob 908*b*. The pin 902*b* is configured to rotate within each of the second knob 908*b* and the second knob 912*b*. The connection of the pins 902*a*, 902*b* within the respective first knob 908*a*, the second knob 908*b*, the first knob 912*a*, and the second knob 912*b* provides a central attachment point between the first plate 808 and the second plate 810 of the sole structure 806. This connection of the pins 902*a*, 902*b* within the first knob 908*a*, the second knob 908*b*, the first knob 912*a*, and the second knob 912*b* allows the sole structure 806 to move (e.g., pivot) toward either of the lateral side 22 or the medial side 24.

The first cushioning element 812*a* is disposed adjacent to the lateral side 24 between the first plate 808 and the second plate 810 (see FIG. 8). The second cushioning element 812*b* is disposed adjacent to the medial side 22 between the first plate 808 and the second plate 810 (see FIG. 8).

Figure 11:
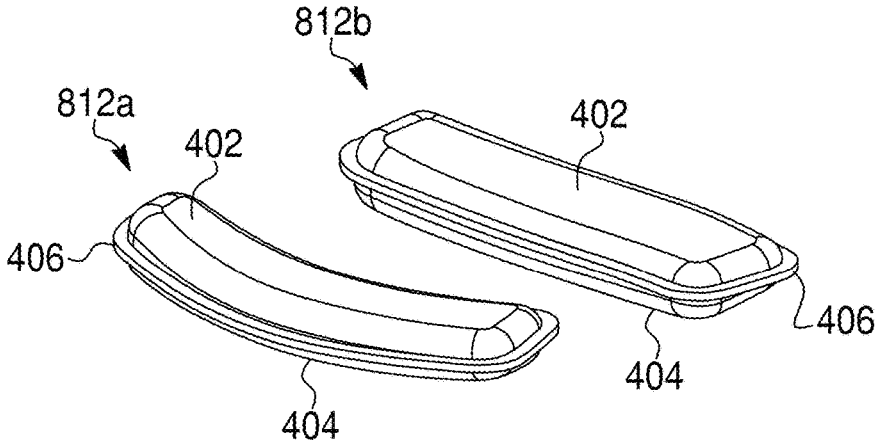
FIG. 11 is a perspective view of a cushioning element of the article of footwear of FIG. 8.

FIG. 11 illustrates a perspective view of the cushioning elements 812*a*, 812*b*. The cushioning elements 812*a*, 812*b* may be a fluid-filled bladder, for example, that may be inflated to provide a desired form of cushioning and support. Each of the cushioning elements 812*a*, 812*b* may be substantially similar to the cushioning element 112 shown and described above.

Figure 12A:
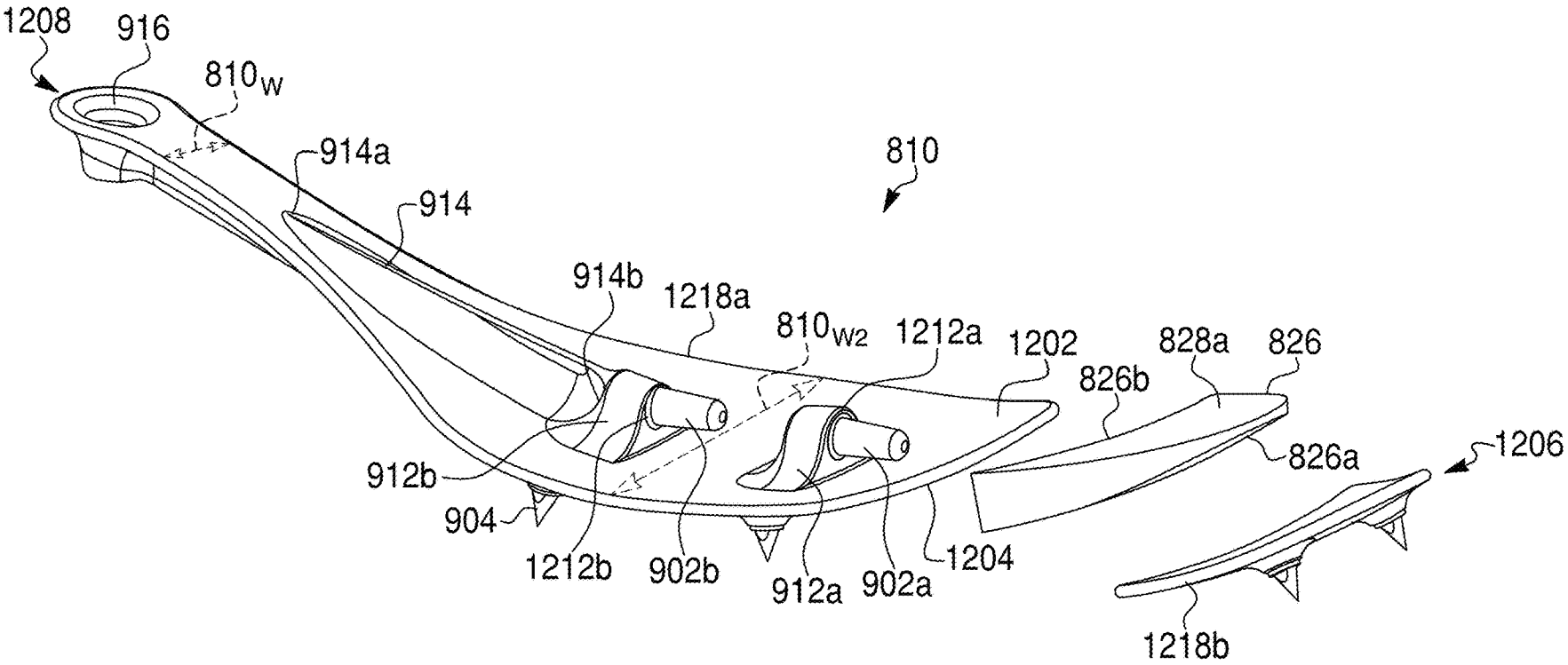
FIG. 12A is a top perspective view of a second plate of the sole structure of FIG. 9.

FIG. 12A illustrates a top perspective view of the second plate 810. The second plate 810 includes a first (anterior) end 1206 and a second (posterior) end 1208. The first end 1206 is disposed at the anterior end 18 of the sole structure 806. The second end 1208 is disposed at the posterior end 20 of the sole structure 806. The one or more apertures 916 are disposed through the first surface 1202 and the second surface 1204. In an example, the second plate 810 is generally pear-shaped. The second plate 810 may be shaped to correspond with and/or compliment the shape of the first plate 808. In other examples, the second plate 810 may have a generally consistent shape. The second plate 810 may be shaped in any manner to provide a desired form of cushioning and support to a foot of a user of the article of footwear 800. As will be described in further detail below, the second plate 810, particularly adjacent the second end 1208, is configured to operate as a torsion bar suspension for the sole structure 806. In the example, the second plate 810 includes one aperture 916 that extends through the first surface 1202 and the second surface 1204 adjacent to the second end 1208.

In examples, the second plate 810 has a variable width. In an example, the second plate 810 includes a first width $\mathbf{810}_W$. The first width $\mathbf{810}_W$ is a width of a narrow portion of the second plate 810. The narrow portion of the second plate 810 corresponds with rear portions of the second plate 810 adjacent to the second end 1208. In other words, the narrow portion of the second plate 810 is disposed in the heel region of the sole structure 806. In an example, the second plate 810 includes a second width $\mathbf{810}_{W2}$. The second width $\mathbf{810}_{W2}$ is a width of a wide portion of the second plate 810. The wide portion of the second plate 810 corresponds with forward portions of the second plate 810 adjacent to the first end 1206. In other words, the wide portion of the second plate 810 is disposed in the forefoot region of the sole structure 806. In an example, the first width $\mathbf{808}_W$ is smaller than the second width $\mathbf{810}_{W2}$. In some examples, about 50% of the second plate 810 has a first width that is the first width $\mathbf{810}_W$ while about 50% of the second plate 810 has a second width that is the second width $\mathbf{810}_{W2}$. In some examples, between about 10% to about 60% of the second plate 810 has a first width that is the first width $\mathbf{810}_W$ while about 40% to about 90% of the second plate 810 has a second width that is the second width $\mathbf{810}_{W2}$.

The first surface 1202 of the second plate 810 faces the second surface 1004 of the first plate 808, when the sole structure 806 is fully assembled. The second surface 1204 faces a ground surface (not shown and includes the one or more traction elements 904. The one or more traction elements 904 extend outwardly (e.g., downwards) from the second surface 1204 toward a ground surface (not shown). The second surface 1204 and the traction elements 904 form a ground-engaging surface of the footwear 800.

The one or more knobs 912*a*, 912*b* extend outwards (e.g., upwards) from the first surface 1202 toward the second surface 1004 of the first plate 808. The one or more knobs 912*a*, 912*b* include a first knob 912*a* and a second knob 912*b*. The first knob 912*a* includes a first opening 1212*a*. The second knob 912*b* includes a second opening 1212*b*. The knobs 912*a*, 912*b* are disposed near the anterior end 1206 relative to the posterior end 1208. In an example, the first knob 912*a* is disposed near the anterior end 1206 relative to the second knob 912*b*. In an example, each of the knobs 912*a*, 912*b* are rounded. In other examples, the knobs 912*a*, 912*b* may be triangular, square, hexagonal, or any other shape.

The first pin 902*a* is configured to extend through the first opening 1212*a*. The second pin 902*b* is configured to extend through the second opening 1212*b*. The first pin 902*a* is disposed within the first opening 1212*a*. The second pin 902*b* is disposed within the second opening 1212*b*. The first pin 902*a* is held within the first opening 1212*a* of the first knob 912*a* by a mechanical fit (e.g., press fit, interference fit, etc.). The second pin 902*b* is held within the second opening 1212*b* of the second knob 912*b* by a mechanical fit (e.g., press fit, interference fit, etc.). The first pin 902*a* and the second pin 902*b* are each substantially cylindrical in shape. In some examples, the pins 902*a*, 902*b* may be hexagonal, conical, triangular, or any other shape suitable for extending through the first opening 1212*a* and/or the second opening 1212*b*. The pins 902*a*, 902*b* form a rotation point for the sole structure 806 when coupled to the knobs described above, thereby providing a rocking mechanism for the article of footwear 800. Additionally, the connection of the pins 902*a*, 902*b* within the first knob 908*a*, the second knob 908*b*, the first knob 912*a*, and the second knob 912*b* allows the sole structure 806 to operate as a torsion bar suspension system. For example, the sole structure 806 is held in place at the posterior end 20 and moves (e.g., pivots or twists) adjacent the anterior end 18.

The fin 914 extends outwardly (e.g., upwards) from and along the first surface 1202. In an example, the fin 914 has a longitudinal length that extends from a first end 914*a* that is disposed adjacent to the aperture 916 to a second end 914*b* that is disposed adjacent to the second knob 912*b*. In some examples, the fin 914 is disposed centrally along the first surface 1202. The fin 914 may be positioned anywhere along the first surface 1202 as desired to aid medial and lateral movement of the first plate 908. The fin 914 is sized, shaped, and/or otherwise configured to form a sloped ramp on first surface 1202. For example, the fin 914 includes a central portion that is elevated relative to peripheral portions of the fin 914 and the first surface 1202 of the second plate 810. In an example, a cross-sectional profile of the fin 914 follows the general curvature of the first surface 1202. For example, the fin 914 is sized, shaped, and/or otherwise configured to provide a fulcrum on the second plate 810 to facilitate the corresponding movement for the first plate 808 relative to the second plate 810.

Figure 12B:
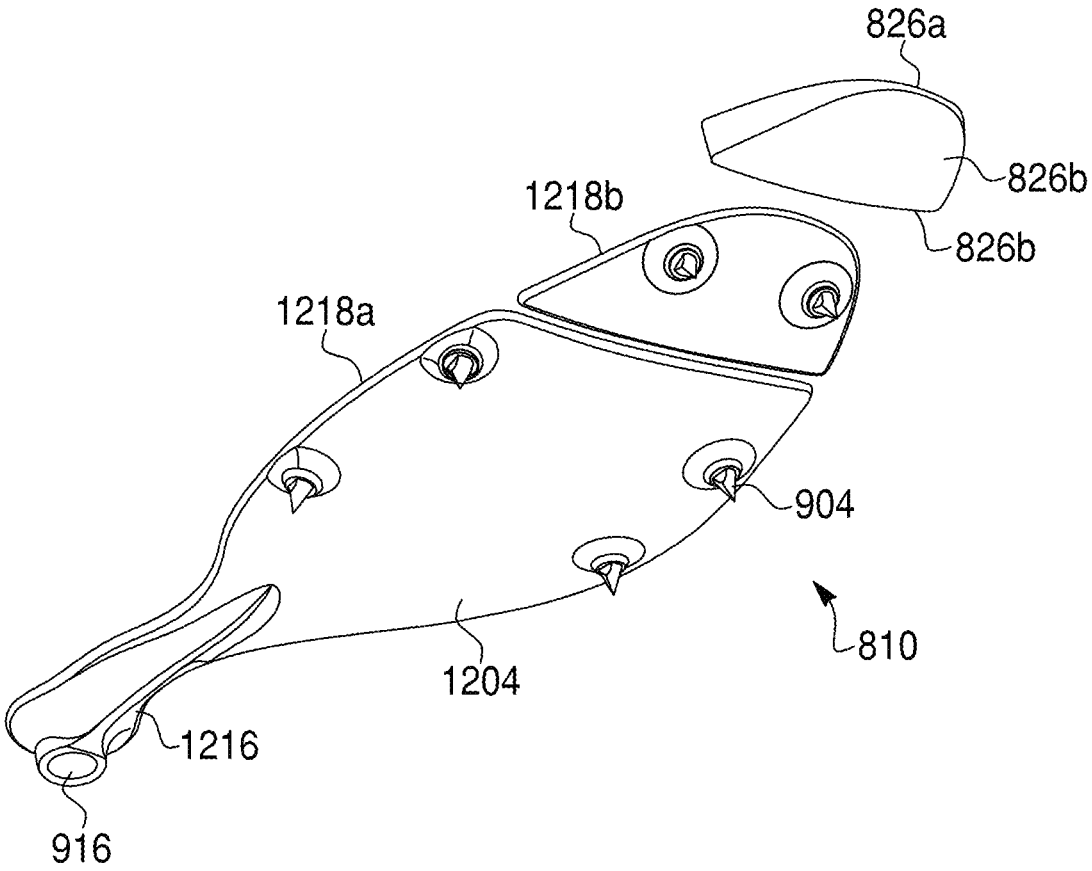
FIG. 12B is a bottom perspective view of the second plate of the sole structure of FIG. 9.

The third cushioning element 826 is disposed adjacent to the anterior end 1206. In an example, the third cushioning element 826 is a foamed element. The third cushioning element 826 includes a first end 826*a* that is generally rounded and a second end 826*b* that is generally flat, as best shown in FIG. 12B. The third cushioning element 826 includes a first surface 828*a* and a second surface 828*b* (shown in FIG. 12B) that is opposite the first surface 828*a*. The first surface 828*a* faces the second surface 1004 of the first plate 808. The second surface 828*b* faces the ground surface (not shown). The first surface 828*a* is configured to be coupled to the first plate 808 via adhesive (e.g., glue, wet cement bonding, or the like). The second surface 828*b* is configured to be coupled to the second plate 810 via adhesive (e.g., glue, wet cement bonding, or the like). The third cushioning element 826 is configured to moderate medial and lateral movements of the first plate 808 relative to the second plate 810. In other words, the third cushioning element 826 limits the movement of the first plate 808 relative to the second plate 810.

Referring to FIG. 12B, a bottom perspective view of the second plate 810 is shown. The second surface 1204 includes a support structure 1216. In an example, the second plate 810 further includes a base plate 1218*a* coupled to a support plate 1218*b*. In some examples, the base plate 1218*a* and the support plate 1218*b* form a continuous body of the second plate 810. In other examples, the base plate 1218*a* and the support plate 1218*b* are compositely formed such that they are not in contact with another. The support structure 1216 extends outwardly (e.g., downwards) away from the second surface 1204. The support structure 1216 is positioned on and/or extends outwardly away from the second surface 1204, such as in a downwards direction from an exterior of the second surface 1204. Support structure 1216 is disposed adjacent the second end 1208. The support structure 1216 provides support to the base plate 1218*a*. The aperture 916 extends through the support structure 1216. The one or more traction elements 904 extend outwardly (e.g., downwards) from the second surface 1204. The one or more traction elements 904 may be disposed on one or both of the base plate 1218*a* and the support plate 1218*b*. In some examples, the one or more traction elements 904 are permanently affixed to the second surface 1204. In other examples, the one or more traction elements 904 are configured to be removed from the second plate 810 and replaced.

As will be described herein, to provide the banking angle relative to a ground surface shown in FIG. 13A, the cushioning element 812*a* of the article of footwear 800 is positioned on the lateral side 24 and the cushioning element 812*b* of the article of footwear 800 is positioned on the medial side 22, as shown in FIG. 8. The banking angle is an angle formed along the second surface 1004 of the first plate 808 relative to the ground surface when the user of the article of footwear 800 is, for example, turning around a corner on a track.

Figure 13A:
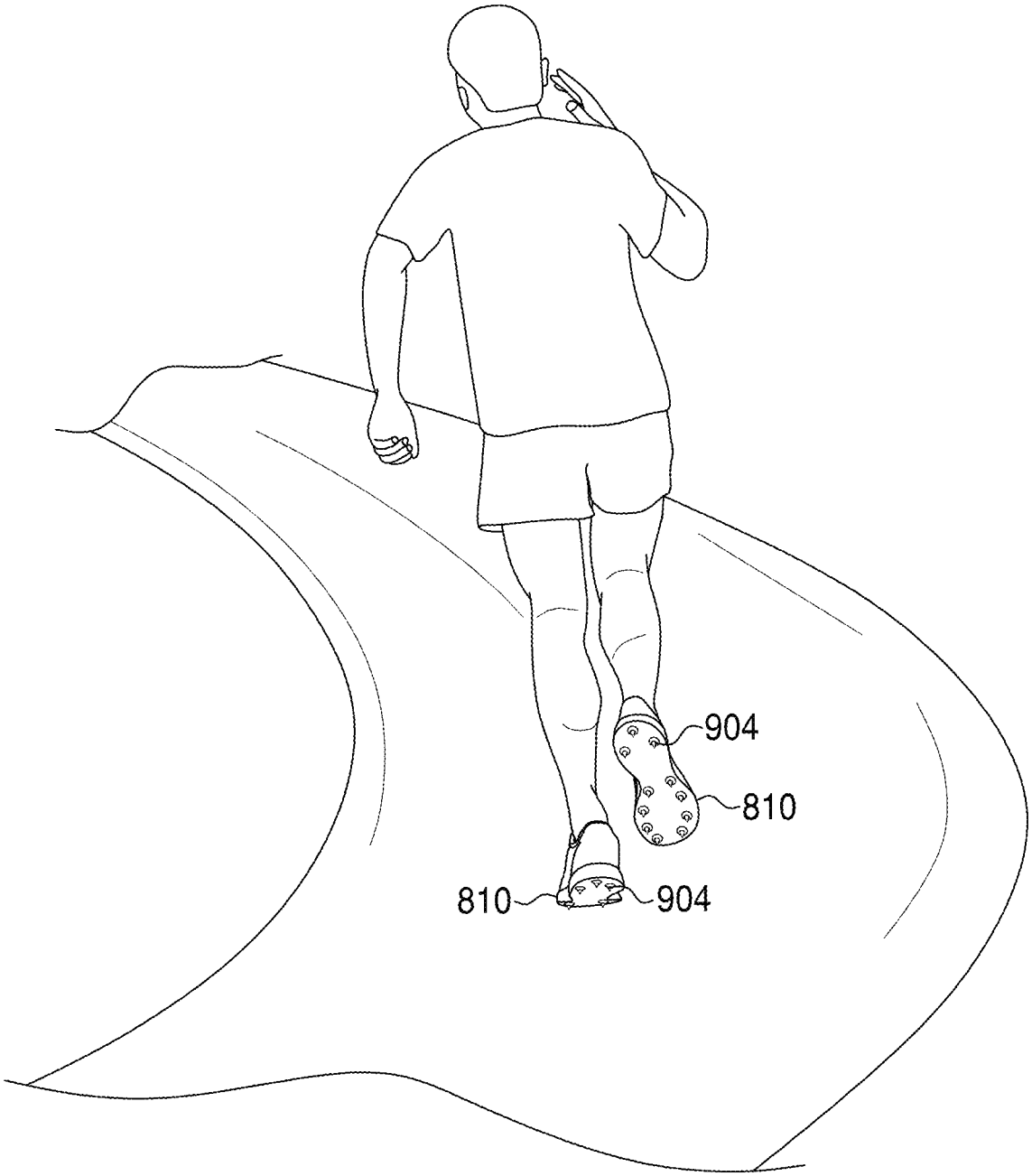
FIG. 13A is an exemplary view of a user wearing the article of footwear of FIG. 8.
Figure 13B:
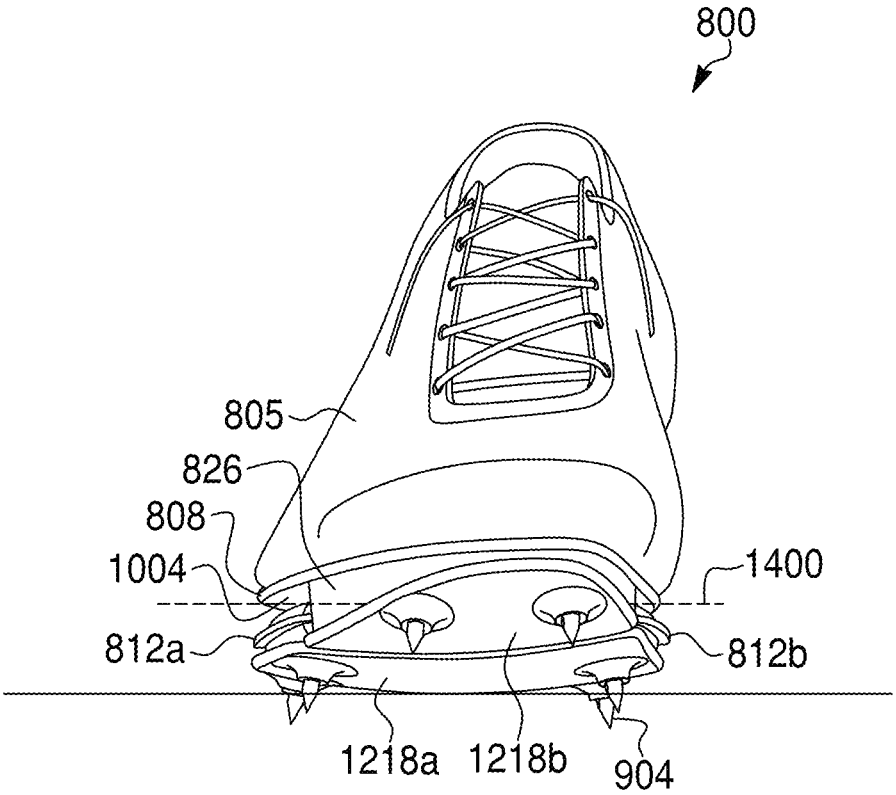
FIG. 13B is a front view of the article of footwear of FIG. 8 in a first configuration.

FIGS. 13A-13D show a banking angle for the article of footwear 800 that is variable (e.g., changing) during use, and particularly in response to a movement of a user. FIG. 13A shows a user of the article of footwear 800 banking while using the article of footwear 800 along a bank and/or a sloped surface. As shown in FIG. 13B, a neutral position of the article of footwear 800 is shown, such as when the user is moving (e.g., walking, jogging, running, etc.) in a generally straight direction with a plane 1400 extending along the second surface 1004 of the first plate 808 being substantially parallel with the ground surface 600. In the neutral position, each article of footwear 802, 804 is substantially parallel to the ground surface 600 and has a minimum banking angle relative to the ground surface 600, which in some examples will be approximately zero or a zero-banking angle.

Figure 13C:
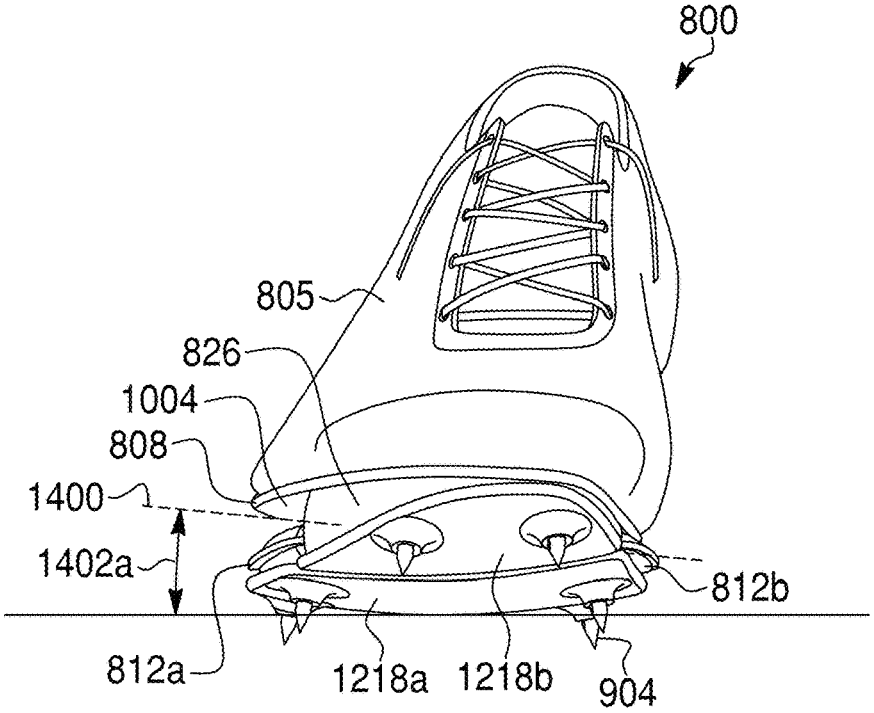
FIG. 13C is a front view of the article of footwear of FIG. 8 in a second configuration.
Figure 13D:
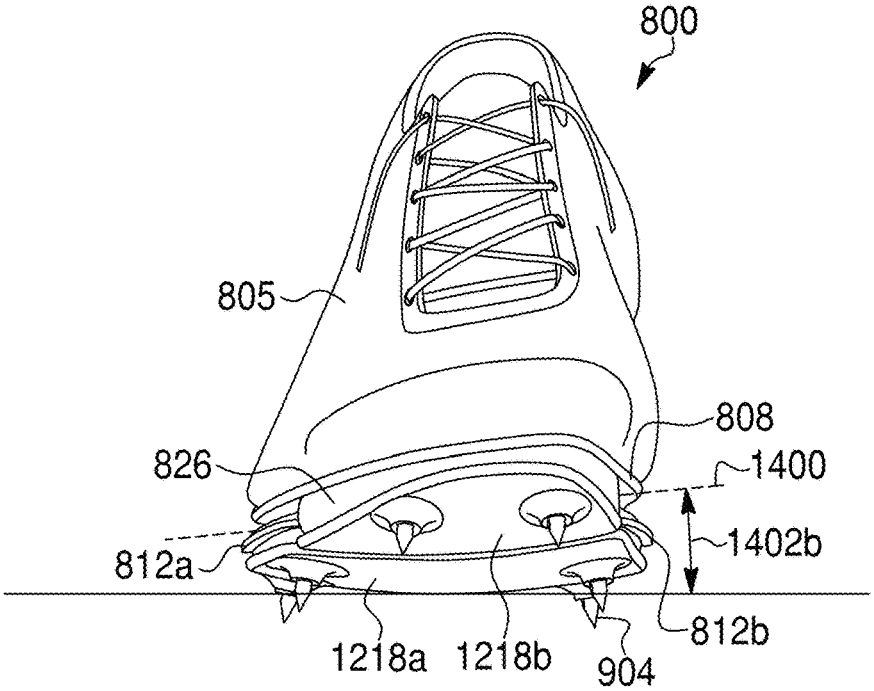
FIG. 13D is a front view of the article of footwear of FIG. 8 in a third configuration.

As shown in FIG. 13C, a first banked position of the article of footwear 800 is shown when the user is moving (e.g., walking, jogging, running, etc.) along a bank (e.g., a sloped surface on a track) and the article of footwear 800 tilts to form a first angle 1402*a* (e.g., a first banking angle) between the ground surface 600 and the plane 1400. As the user moves along a banked surface, the user's weight moves (e.g., pivots, shifts, tilts, etc.) the first plate 808 onto the first cushioning element 812*a*. The first cushioning element 812*a* may be compressed to a maximum compression limit of the cushioning element 812*a*. The second cushioning element 812*b* may be compressed to a maximum compression limit of the second cushioning element 812*b*. In an example, as shown in FIG. 13D, a second banked position of the article of footwear 800 is shown when the user is coming out of a bank along a straight and the article of footwear 800 tilts to form a second angle 1402*b* (e.g., a second banking angle) between the ground surface 600 and the plane 1400. As the user comes out of the bank, the cushioning elements 812*a*, 812*b* are configured to apply restorative forces to push the first plate 808 back towards the neutral position shown in FIG. 13B in response to the user exiting the bank and the user's weight shifting. The compression of the cushioning elements 812*a*, 812*b* provide a desired form of stability to the user of the article of footwear 800.

In some examples, the cushioning elements 812*a*, 812*b* may be fully compressed to about 100% of the compression limit of the cushioning elements 812*a*, 812*b*. In some examples, the cushioning elements 812*a*, 812*b* may be partially compressed to any percentage of the compression limit of the cushioning elements 812*a*, 812*b* corresponding to the force applied by the user of the article of footwear 800. In some examples, the cushioning elements 812*a*, 812*b* may be partially compressed to about 75% of the compression limit of the cushioning elements 812*a*, 812*b*. In some examples, the cushioning elements 812*a*, 812*b* may be partially compressed to about 50% of the compression limit of the cushioning elements 812*a*, 812*b*. In some examples, the cushioning elements 812*a*, 812*b* may be partially compressed to about 25% of the compression limit of the cushioning elements 812*a*, 812*b*.

The cushioning elements 812*a*, 812*b* are configured to be compressed, thereby generating the first and second (banking) angles 1402*a*, 1402*b*, which can vary depending on application. The compression of the first cushioning element 812*a* in the medial direction forms the first (banking) angle 1402*a*. The compression of the second cushioning element

812*b* in the lateral direction forms the second (banking) angle 1402*b*. For example, with a maximum of the first and second (banking) angles 1402*a*, 1402*b* of about 20 degrees, the desired banking angle would be able to vary between about 0 and about 20 degrees. In some examples, higher or lower maximum banking angles can be achieved. In some examples, the maximum first and second (banking) angles 1402*a*, 1402*b* are about 30 degrees, respectively. In some examples, the maximum first and second (banking) angles 1402*a*, 1402*b* are about 50 degrees, respectively. In some examples, the maximum first and second (banking) angles 1402*a*, 1402*b* are about 80 degrees, respectively. In some examples, the maximum first and second (banking) angles 1402*a*, 1402*b* are about 18 degrees. In some examples, the maximum first and second (banking) angles 1402*a*, 1402*b* are about 15 degrees, respectively. In some examples, the maximum first and second (banking) angles 1402*a*, 1402*b* are about 10 degrees, respectively.

As discussed above, the sole structures 106 and 806 described herein comprise an adaptive-height sole structure 106 and 806 that can vary the nature of the support of the sole structure 106 and 806 to provide an article of footwear 100 and 800 that supports the user's foot in a manner that can vary in angle, curvature, orientation, and/or shape of the surface receiving the wearer's foot. In this manner, the sole structure 106 and 806 can adapt or change to provide a desired form of cushioning, stability, support, and/or comfort in situations where a non-flat orientation of the wearer's foot is desirable. More specifically, the sole structure 106 and 806 can provide a desired form of cushioning, stability, support, and/or comfort during banking while the wearer is using the article of footwear 100 and 800 on a track. For example, the sole structure 106 and 806 can provide increased stability performance when the wearer is turning while walking or running on a track such as when running counterclockwise on a curved portion of a track, as shown and described in FIGS. 7A and 13A.

Figure 14:
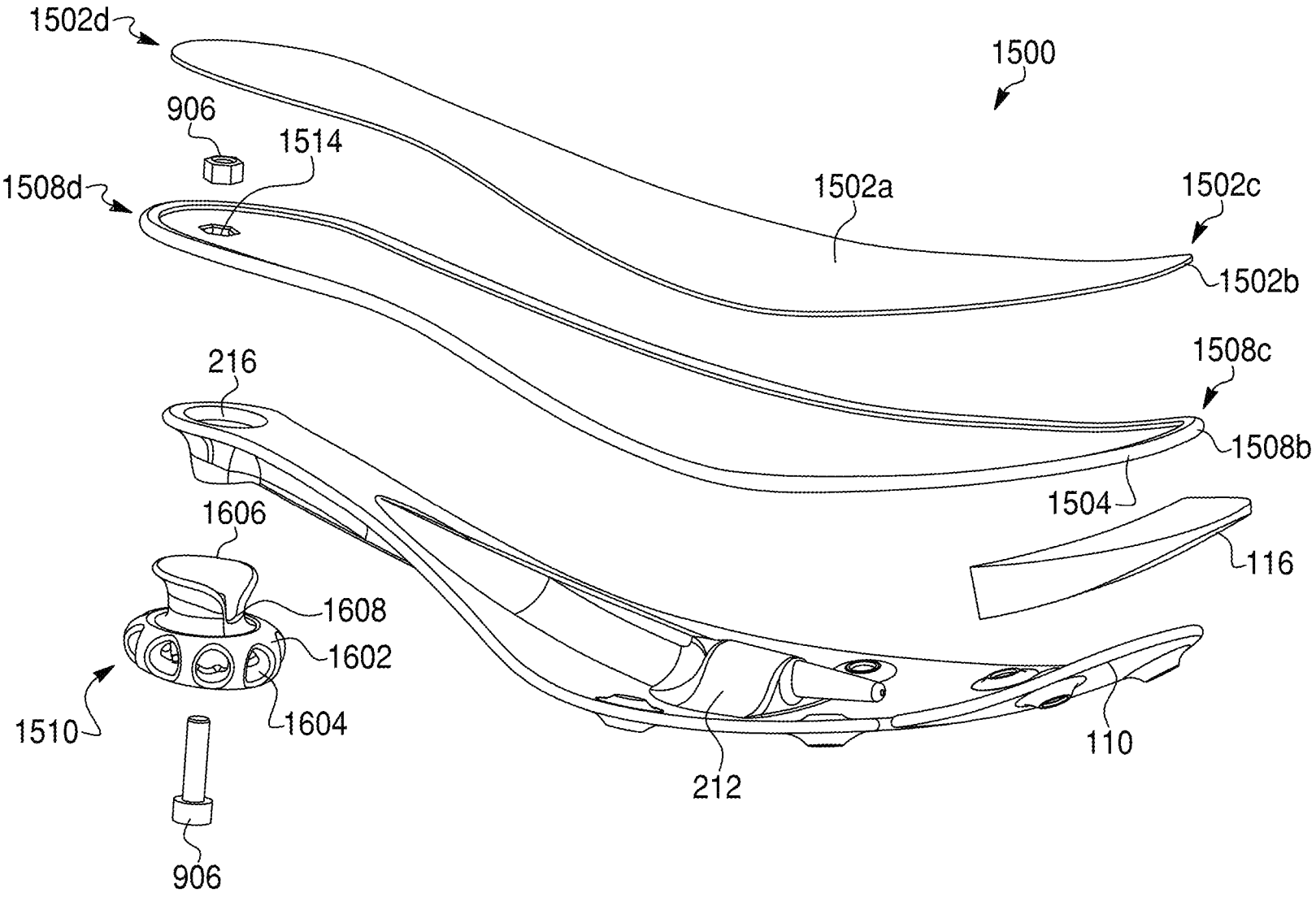
FIG. 14 is an exploded view of a sole structure of an alternative article of footwear.

FIG. 14 depicts an alternate sole structure 1500. The alternate sole structure 1500 is similar to sole structure 106 except as indicated below. Like reference numerals are used for sole structure 1500 where similar to sole structure 106. The sole structure 1500 includes a first plate 1502, a support plate 1504, a cap 1510, the one or more fasteners 206, the third cushioning element 116, and the second plate 110. While not explicitly shown, the sole structure 1500 can be employed similarly to the sole structure 106 and can include the cushioning elements 112*a*, 112*b*.

The first plate 1502 includes a first surface 1502*a* and a second surface 1502*b* disposed opposite to the first surface 1502*a*. The first plate extends from a first end 1502*c* to a second end 1502*d*. The first plate 1502 is similarly shaped to the first plate 108. The first surface 1502*a* of the first plate 1502 is configured to abut or otherwise attached to the upper 105 (not shown).

The support plate 1504 includes a first surface 1508*a* and a second surface 1508*b* disposed opposite to the first surface 1508*a*. The support plate extends from a first end 1508*c* to a second end 1508*d*. The support plate 1504 includes an aperture 1514 disposed through support plate 1504. The aperture 1514 is disposed adjacent the second end 1508*d* of the support plate 1504. The first surface 1508*a* is a recessed surface of the support plate 1504 such that a lip 1512 is formed surrounding the first surface 1508*a*. In other words, the first surface 1508*a* is recessed relative to the lip 1512. The first surface 1508*a* is configured to receive the first plate 1502 within an inner boundary of the lip 1512. The second surface 1502*b* of the first plate 1502 abuts the first surface 1508*a* of the support plate 1504. When the first plate 1502 is disposed within the lip 1512 and contacting the first surface 1508*a*, the first plate 1502 inhibits or otherwise blocks the aperture 1514 at the first surface 1508*a*.

The support plate 1504 includes a knob 1506. The knob 1506 extends from the second surface 1508*b* of the support plate 1504. The knob 1506 is similar to the knob 208 of the first plate 108.

The cap 1510 includes a body 1602, one or more openings 1604, and a stem 1606. The one or more openings 1604 are disposed within a structure of the body 1602. The one or more openings 1604 have a circular shape. In some examples, he one or more openings 1604 are separated by the structure of the body 1602. The structure of the body 1602 is rounded and surrounds an interior volume. The one or more openings 1604 provide ingress to the interior volume of the body 1602. The stem 1606 extends through the structure of the body 1602 into the interior volume of the body 1602. The stem 1606 includes a scoop 1608. The scoop 1608 facilitates coupling of the cap 1510 to portions of the sole structure 1500. For example, when assembled, the cap 1510 is configured to couple to portions of the second plate 110. The scoop 1608 accommodates the shape of portions of the second plate 110.

In some examples, the cap 1510 may be removably attached to the sole structure 1500. The cap 1510 may protect respective portions of the sole structure 1500 when desired by the user. In other examples, the cap 1510 may be permanently attached to the sole structure 1500.

Figure 15:
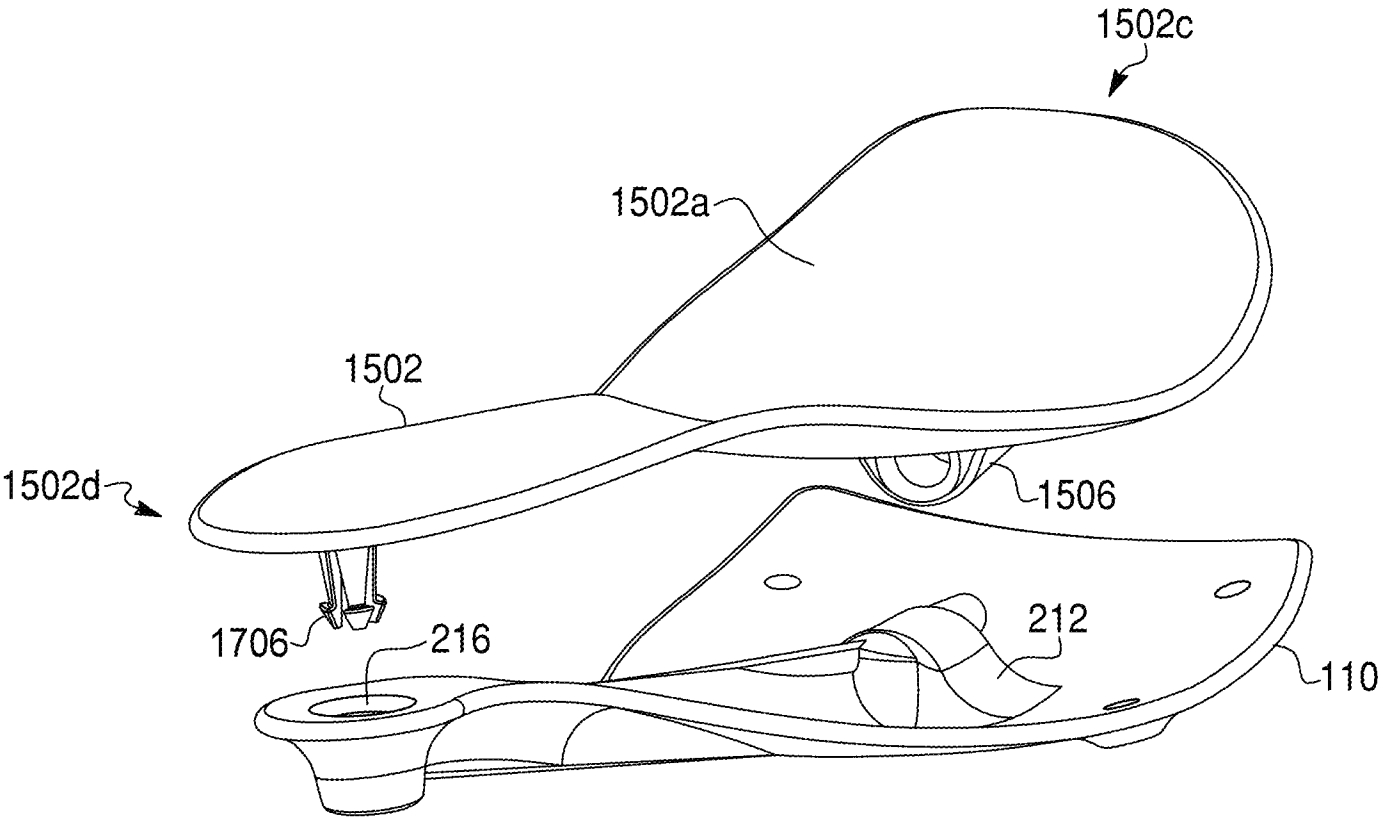
FIG. 15 is an exploded view of a sole structure of an alternative article of footwear.

As shown in FIG. 15, the one or more fasteners may be a pronged fastener 1706 that is configured to mechanically lock within the aperture 216. In such an example, when the one or more fasteners are the pronged fastener 1706, the pronged fastener is configured to snap fit the support plate 1504 to the second plate 110.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The following clauses provide an exemplary configuration for an article of footwear and sole structure described above.

Clause 1. An article of footwear comprising: a medial side; a lateral side that is positioned opposite to the medial side; an upper; and a sole structure coupled to the upper, the sole structure comprising: a first plate having a first surface and a second surface opposite to the first surface, the first plate including a first knob extending from the second surface and one or more apertures disposed through the first surface and the second surface; a second plate having a first surface and a second surface opposite the first surface of the second plate, the second plate including a second knob extending from the first surface of the second plate and one or more apertures disposed through the first surface of the second plate; a first cushioning element disposed on the medial side of the article of footwear, wherein the first cushioning element is disposed between the first plate and the second plate; and a second cushioning element disposed on the lateral side of the article of footwear, wherein the second cushioning element is disposed between the first plate and the second plate.

Clause 2. The article of footwear of Clause 1, wherein each of the first cushioning element and the second cushioning element are a fluid-filled bladder.

Clause 3. The article of footwear of Clause 1, wherein the second knob of the second plate is disposed between the first cushioning element and the second cushioning element.

Clause 4. The article of footwear of Clause 3, wherein the first knob is disposed centrally along the second surface of the first plate, and the second knob is disposed centrally along a lateral side of the second plate.

Clause 5. The article of footwear of Clause 4, wherein the first knob and the second knob are coupled to one another via a pin.

Clause 6. The article of footwear of Clause 5, wherein the first plate is configured to compress the first cushioning element and the second cushioning element in response to one or more forces from a user of the article of footwear.

Clause 7. The article of footwear of Clause 1, wherein the sole structure comprises a third cushioning element disposed anterior to the first cushioning element and the second cushioning element.

Clause 8. The article of footwear of Clause 1, wherein the second plate includes a support plate and a base plate that are coupled to one another to form a continuous surface extending across a longitudinal length of the second plate.

Clause 9. An article of footwear configured to transition between a neutral position and a banked position, the article of footwear comprising: an upper; and a sole structure coupled to the upper, the sole structure comprising: a first plate having a first surface and a second surface opposite the first surface; a second plate having a first surface and a second surface opposite the first surface of the second plate; a first cushioning element disposed between the first plate and the second plate, the first cushioning element is configured to transition between a resting state and a compressed state; and a second cushioning element disposed between the first plate and the second plate, the second cushioning element is configured to transition between a resting state and a compressed state; wherein, while each of the first cushioning element and the second cushioning element are in the resting state, a first plane extending along the second surface of the first plate and a second plane extending along the second surface of the second plate are parallel with a ground surface, wherein, while each of the first cushioning element and the second cushioning element are in the compressed state, a force from the first plate acts on either 1) the first cushioning element causing the first plane extending along the second surface of the first plate to form an angle between the ground surface and the first plane, or 2) the second cushioning element causing the second plane extending along the second surface of the first plate to form an angle between the ground surface and the second plane.

Clause 10. The article of footwear of Clause 9, wherein each of the first cushioning element and the second cushioning element is a fluid-filled bladder.

Clause 11. The article of footwear of Clause 9, wherein the angle is greater than 0 degrees and less than 20 degrees.

Clause 12. The article of footwear of Clause 9, wherein in the neutral position, each of the first cushioning element and the second cushioning element is in the resting state.

Clause 13. The article of footwear of Clause 9, wherein in the banked position, the first cushioning element is in the compressed state and the second cushioning element is in the resting state.

Clause 14. The article of footwear of Clause 9, wherein the second surface of the second plate forms a ground-engaging surface of the article of footwear.

Clause 15. The article of footwear of Clause 9, wherein the second plate includes one or more traction elements extending from the second surface of the second plate.

Clause 16. An article of footwear comprising: a medial side; a sole structure coupled to the upper, the sole structure comprising: a first plate having a first surface and a second surface opposite the first surface, the first plate including a first set of knobs extending from the second surface and one or more apertures disposed through the first surface and the second surface; a second plate having a first surface and a second surface opposite the first surface of the second plate, the second plate including a second set of knobs extending from the first surface of the second plate and one or more apertures disposed through the first surface and the second surface of the second plate; a first cushioning element disposed on the medial side of the article of footwear, wherein the first cushioning element is disposed between the first plate and the second plate; and a second cushioning element disposed on the lateral side of the article of footwear, wherein the second cushioning element is disposed between the first plate and the second plate.

Clause 17. The article of footwear of Clause 16, wherein the second plate includes a support plate and a base plate that are coupled to one another to form a continuous surface extending across a longitudinal length of the second plate.

Clause 18. The article of footwear of Clause 16, wherein the sole structure includes a third cushioning element disposed anterior to the first cushioning element and the second cushioning element.

Clause 19. The article of footwear of Clause 16, wherein a first force applied to the first plate is configured to compress the first cushioning element and a second force different from the first force applied to the first plate is configured to compress the second cushioning element; and wherein the first cushioning element is configured to apply a third force to the first plate and the second cushioning element is configured to apply a fourth force to the first plate.

Clause 20. The article of footwear of Clause 16, wherein each knob of the first set of knobs includes a first opening, and each knob of the second set of knobs includes a second opening.

Clause 21. The article of footwear of Clause 20, wherein a first pin is disposed between the first opening of a first knob of the first set of knobs and a first opening of a first knob of the second set of knobs, and wherein a second pin is disposed between the second opening of a second knob of the second set of knobs and the second opening of a second knob of the first set of knobs.

Clause 22. The article of footwear of Clause 16, wherein the one or more apertures of the first plate includes a first aperture disposed adjacent to the first set of knobs, at least one knob of the first set of knobs extending through at least one aperture of the one or more apertures.

We claim:

1. An article of footwear comprising:

a medial side;

a lateral side that is positioned opposite to the medial side;

an upper; and a sole structure coupled to the upper, the sole structure comprising:

a first plate having a first surface and a second surface opposite to the first surface, the first plate including a first knob extending from the second surface and one or more apertures disposed through the first surface and the second surface;

a second plate having a first surface and a second surface opposite the first surface of the second plate, the second plate including a second knob extending from the first surface of the second plate and one or more apertures disposed through the first surface of the second plate;

a first cushioning element disposed on the medial side of the article of footwear, wherein the first cushioning element is disposed between the first plate and the second plate; and a second cushioning element disposed on the lateral side of the article of footwear, wherein the second cushioning element is disposed between the first plate and the second plate.

2. The article of footwear of claim 1, wherein each of the first cushioning element and the second cushioning element are a fluid-filled bladder.

3. The article of footwear of claim 1, wherein the second knob of the second plate is disposed between the first cushioning element and the second cushioning element.

4. The article of footwear of claim 3, wherein the first knob is disposed centrally along the second surface of the first plate, and the second knob is disposed centrally along a lateral side of the second plate.

5. The article of footwear of claim 4, wherein the first knob and the second knob are coupled to one another via a pin.

6. The article of footwear of claim 5, wherein the first plate is configured to compress the first cushioning element and the second cushioning element in response to one or more forces from a user of the article of footwear.

7. The article of footwear of claim 1, wherein the sole structure comprises a third cushioning element disposed anterior to the first cushioning element and the second cushioning element.

8. The article of footwear of claim 1, wherein the second plate includes a support plate and a base plate that are coupled to one another to form a continuous surface extending across a longitudinal length of the second plate.

9. An article of footwear configured to transition between a neutral position and a banked position, the article of footwear comprising:

an upper; and a sole structure coupled to the upper, the sole structure comprising:

a first plate having a first surface and a second surface opposite the first surface;

a second plate having a first surface and a second surface opposite the first surface of the second plate;

a third plate having a first surface and a second surface opposite the first surface of the second plate, wherein the third plate is disposed anterior to the second plate;

a first cushioning element disposed between the first plate and the second plate, the first cushioning element is configured to transition between a resting state and a compressed state;

a second cushioning element disposed between the first plate and the second plate, the second cushioning element is configured to transition between a resting state and a compressed state; and a third cushioning element disposed between the first plate and the third plate and the third cushioning element disposed anterior to each of the first cushioning element and the second cushioning element, the third cushioning element configured to transition between a resting state and a compressed state;

wherein, while each of the first cushioning element and the second cushioning element are in the resting state, a first plane extending along the second surface of the first plate and a second plane extending along the second surface of the second plate are parallel with a ground surface, wherein, while each of the first cushioning element and the second cushioning element are in the compressed state, a force from the first plate acts on either 1) the first cushioning element causing the first plane extending along the second surface of the first plate to form an angle between the ground surface and the first plane, or 2) the second cushioning element causing the second plane extending along the second surface of the first plate to form an angle between the ground surface and the second plane.

10. The article of footwear of claim 9, wherein each of the first cushioning element and the second cushioning element is a fluid-filled bladder.

11. The article of footwear of claim 9, wherein in the neutral position, each of the first cushioning element and the second cushioning element is in the resting state.

12. The article of footwear of claim 9, wherein in the banked position, the first cushioning element is in the compressed state and the second cushioning element is in the resting state.

13. The article of footwear of claim 9, wherein the second surface of the second plate forms a ground-engaging surface of the article of footwear.

14. The article of footwear of claim 9, wherein the second plate includes one or more traction elements extending from the second surface of the second plate.

15. An article of footwear comprising:

a medial side;

a lateral side positioned opposite to the medial side;

an upper; and a sole structure coupled to the upper, the sole structure comprising:

a first plate having a first surface and a second surface opposite the first surface, the first plate including a first set of knobs extending from the second surface and one or more apertures disposed through the first surface and the second surface;

a second plate having a first surface and a second surface opposite the first surface of the second plate, the second plate including a second set of knobs extending from the first surface of the second plate and one or more apertures disposed through the first surface and the second surface of the second plate;

a first cushioning element disposed on the medial side of the article of footwear, wherein the first cushioning element is disposed between the first plate and the second plate; and a second cushioning element disposed on the lateral side of the article of footwear, wherein the second cushioning element is disposed between the first plate and the second plate.

16. The article of footwear of claim 15, wherein the second plate includes a support plate and a base plate that are coupled to one another to form a continuous surface extending across a longitudinal length of the second plate.

17. The article of footwear of claim 15, wherein the sole structure includes a third cushioning element disposed anterior to the first cushioning element and the second cushioning element.

18. The article of footwear of claim 15, wherein a first force applied to the first plate is configured to compress the first cushioning element and a second force different from the first force applied to the first plate is configured to compress the second cushioning element; and wherein the first cushioning element is configured to apply a third force to the first plate and the second cushioning element is configured to apply a fourth force to the first plate.

19. The article of footwear of claim 15, wherein each knob of the first set of knobs includes a first opening, and each knob of the second set of knobs includes a second opening.

* * * * *